US008975836B2

(12) United States Patent
Bromberg et al.

(10) Patent No.: US 8,975,836 B2
(45) Date of Patent: Mar. 10, 2015

(54) ULTRA-LIGHT, MAGNETICALLY SHIELDED, HIGH-CURRENT, COMPACT CYCLOTRON

(71) Applicants: Leslie Bromberg, Sharon, MA (US); Joseph V. Minervini, Still River, MA (US); Peisi Le, Boston, MA (US); Alexey L. Radovinsky, Cambridge, MA (US); Phillip C. Michael, Cambridge, MA (US); Timothy A. Antaya, Hampton Falls, NH (US)

(72) Inventors: Leslie Bromberg, Sharon, MA (US); Joseph V. Minervini, Still River, MA (US); Peisi Le, Boston, MA (US); Alexey L. Radovinsky, Cambridge, MA (US); Phillip C. Michael, Cambridge, MA (US); Timothy A. Antaya, Hampton Falls, NH (US)

(73) Assignee: Massachusetts Institute of Technology, Cambridge, MA (US)

( * ) Notice: Subject to any disclaimer, the term of this patent is extended or adjusted under 35 U.S.C. 154(b) by 45 days.

(21) Appl. No.: 13/830,792

(22) Filed: Mar. 14, 2013

(65) Prior Publication Data

US 2014/0087953 A1 Mar. 27, 2014

Related U.S. Application Data

(60) Provisional application No. 61/676,377, filed on Jul. 27, 2012.

(51) Int. Cl.

| | |
|---|---|
| ***H05H 13/00*** | (2006.01) |
| ***H05H 7/04*** | (2006.01) |
| ***H05H 7/00*** | (2006.01) |
| ***H05H 13/02*** | (2006.01) |
| ***H01F 6/06*** | (2006.01) |

(52) U.S. Cl.

CPC . *H05H 7/04* (2013.01); *H05H 7/00* (2013.01); *H05H 13/005* (2013.01); *H05H 13/02* (2013.01); *H01F 6/06* (2013.01)

USPC ..... 315/502; 315/503

(58) Field of Classification Search

USPC ..... 315/500, 501, 502, 503

See application file for complete search history.

(56) References Cited

U.S. PATENT DOCUMENTS

| | | | | |
|---|---|---|---|---|
| 4,943,781 | A | 7/1990 | Wilson et al. | |
| 7,541,905 | B2 * | 6/2009 | Antaya | 335/216 |
| 7,656,258 | B1 | 2/2010 | Antaya et al. | |
| 7,696,847 | B2 * | 4/2010 | Antaya | 335/216 |
| 8,791,656 | B1 * | 7/2014 | Zwart et al. | 315/503 |

OTHER PUBLICATIONS

European Patent Office, International Search Report and Written Opinion of PCT/US2013/052309 (corresponding PCT application) (Dec. 20, 2013).

* cited by examiner

*Primary Examiner* — Thuy Vinh Tran

(74) *Attorney, Agent, or Firm* — Modern Times Legal; Robert J. Sayre

(57) ABSTRACT

A cyclotron for ion acceleration is magnetically shielded during ion acceleration by passing electrical current in the same direction through both the first and second superconducting primary coils. A first magnetic-field-shielding coil is on the same side of the mid plane as the first superconducting primary coil, while a second magnetic-field-shielding coil is on the same side of the midplane as the second superconducting primary coil and beyond the outer radius of the second superconducting primary coil. Electrical current is also passed through the magnetic-field-shielding coils in a direction opposite to the direction in which electrical current is passed through the superconducting primary coils and generates a canceling magnetic field that reduces the magnetic field generated at radii from the central axis beyond the magnetic-field-shielding coils.

24 Claims, 9 Drawing Sheets

ULTRA-LIGHT, MAGNETICALLY SHIELDED, HIGH-CURRENT, COMPACT CYCLOTRON

RELATED APPLICATION

This application claims the benefit of U.S. Provisional Application No. 61/676,377, filed 27 Jul. 2012, the entire content of which is incorporated herein by reference.

GOVERNMENT SUPPORT

This invention was made with Government support under Grant No. HDTRA1-09-1-0042 awarded by the Defense Threat Reduction Agency. The Government has certain rights in this invention.

BACKGROUND

Cyclotrons are used for high-energy particle production. Cyclotron technology has been developed over many decades, and today it is considered a mature technology.

The present approach for making cyclotrons includes the use of magnetic iron poles and iron return yokes, to decrease the quantity of conductor needed to generate the magnetic field. In addition, magnetic iron poles are used for shaping the field. It is well known that the radial and azimuthal field profiles are essential for particle acceleration and for particle stability. For synchrocyclotrons, the axial field component needs to decrease with increasing radius to provide particle stability. For isochronous cyclotrons, the average magnetic field needs to increase to balance the increase in mass with energy of the particle due to relativistic effects, and the field must vary azimuthally to provide beam stability.

The use of superconductivity in cyclotrons opens the potential for compact, high-field devices, and external shielding may be needed to protect surrounding environments from high magnetic fields extending outside the cyclotron.

Yoke-free isochronous cyclotron concepts have been proposed in the past (see U.S. Pat. No. 4,943,781 (Martin N. Wilson, Martin F. Finian, "Cyclotron with Yokeless Superconducting Magnet"). The field shaping for the isochronous cyclotron was achieved using a combination of coils and iron pole tips in the bore of the coils, limiting the flexibility of field shaping by coils that are above/below the beam chamber. There is no mention of any means to minimize the stray magnetic field in this concept.

SUMMARY

Apparatus and methods to provide shielding of external magnet fields generated by cyclotrons are described herein. Various embodiments of the apparatus and methods may include some or all of the elements, features and steps described below.

In various embodiments, a cyclotron can be magnetically shielded during ion acceleration by passing electrical current through first and second superconducting primary coils. Each superconducting primary coil is centered symmetrically about a central axis, one on each side of a midplane intersected perpendicularly by the central axis. The electrical current is passed through the first superconducting primary coil in the same direction as the direction in which electrical current is passed through the second superconducting primary coil. Electrical current is also passed through at least a first and a second magnetic-field-shielding coil. The first magnetic-field-shielding coil is on the same side of the mid plane as the first superconducting primary coil and beyond the outer radius of the first superconducting primary coil, and electrical current is passed through the first magnetic-field-shielding coil in a direction opposite to the direction in which electrical current is passed through the superconducting primary coils. The second magnetic-field-shielding coil is on the same side of the midplane as the second superconducting primary coil and beyond the outer radius of the second superconducting primary coil, and electrical current is passed through the second magnetic-field-shielding coil in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils. An ion is released from an ion source into the midplane proximate the central axis and accelerating the ion in an orbiting trajectory expanding outward from the central axis via a magnetic field generated at least partially by the superconducting primary coils.

In particular embodiments, the magnetic field is shaped in the midplane using at least a first and a second superconducting magnetic-field-shaping coil, wherein the first and second superconducting magnetic-field-shaping coils are positioned at shorter radii from the central axis than the superconducting primary coils. Additionally, because of the unique coil structure described herein, the cyclotron may lack a continuous yoke and pole structure around the superconducting primary coils. The magnetic field in the midplane can be generated by a magnetic-field-generating structure consisting essentially of the superconducting primary coils, the superconducting magnetic-field-shaping coils, and the magnetic-field-shielding coils.

In additional embodiments, because of the absence of nonlinear magnetic materials, such as iron, the magnetic field amplitude can be changed in the midplane while maintaining the magnetic field profile in the midplane and maintaining magnetic shielding by changing the amount of current passed through the superconducting primary coils and through the magnetic-field-shielding coils and by proportionally changing the electrical currents in the superconducting primary coils, in the superconducting field-shaping coils, and in the magnetic-field-shielding coils. Additionally, the accelerated ion can be extracted from the cyclotron with a final energy that changes as the magnetic field is changed. Further, the magnetic field generated in the midplane at radii less than the inner radius of the superconducting primary coils can be greater than 5 Tesla. Further still, the magnetic field generated at radii greater than 1 meter beyond the outer radius of the superconducting primary coils can be reduced to less than 0.001 Tesla by the magnetic-field-shielding coils. In particular embodiments, one 250 MeV cyclotron has a mass less than 5,000 kg.

Moreover, different ions having different masses can be accelerated in the cyclotron. Magnetic fields of different magnitudes can be generated for the different ions, made possible by the absence of nonlinear magnetic elements. In yet other embodiments, a beam-acceleration module including the ion source, radiofrequency electrodes, a beam chamber and a beam-extraction system can be replaced and substituted between accelerations of the different ions. In still more embodiments, at least some of the superconducting magnetic-field-shielding coils can be positioned at radius from the central axis more than 1.5 times the radius of the primary superconducting primary coils. Further still, shielding of magnetic fields generated by the primary coils at radii from the central axis beyond the superconducting primary coils can be provided by a magnetic-field-shielding structure consisting essentially of the superconducting magnetic-field-shielding coils. In additional embodiments, resistive magnetic-field-shielding coils, placed outside of the primary coil cryostat, can be used.

An embodiment of a magnetically shielded, compact cyclotron includes the following components: first and second superconducting primary coils, a current source, at least a first and second magnetic field-shielding coil, and an ion source. Each superconducting primary coil is centered about a central axis, one on each side of a midplane intersected perpendicularly by the central axis. The current source is electrically coupled with the first and second superconducting primary coils and configured to direct electrical current through the first and second superconducting primary coils in the same direction. The magnetic-field-shielding coils are centered about the central axis and at radii from the central axis beyond the superconducting primary coils. The first magnetic-field-shielding coil is positioned on the same side of the midplane as the first superconducting primary coil, and the second magnetic-field-shielding coil is positioned on the same side of the midplane as the second superconducting primary coil. The current source is electrically coupled with the first and second magnetic-field-shielding coils and configured to direct electrical current through the first and second magnetic-field-shielding coils in a direction that is opposite to the direction in which the electrical current is passed through the superconducting primary coils. The ion source, meanwhile, is positioned to release an ion in the midplane for an outwardly orbiting acceleration.

In some embodiments, the cyclotron is a synchrocyclotron. The synchrocyclotron can include a magnetic-field-generating structure consisting essentially of the superconducting primary coils, the superconducting magnetic-field-shaping coils and the magnetic-field-shielding coils. In other embodiments, the cyclotron is an isochronous cyclotron that generates a magnetic field comprising a superposition of an azimuthally fixed magnetic field and an azimuthally varying magnetic field. The isochronous cyclotron can include a magnetic-field-generating structure for generating the azimuthally fixed magnetic field that consists essentially of the superconducting primary coils, the superconducting magnetic-field-shaping coils and the superconducting magnetic-field-shielding coils. The isochronous cyclotron can also include a magnetic-field-generating structure for generating the azimuthally variable magnetic field that consists essentially of sectors of spiral conductive coil windings. Alternatively or additionally, the isochronous cyclotron can include a magnetic-field-generating structure comprising iron for generating the azimuthally variable magnetic field.

Figure 1:
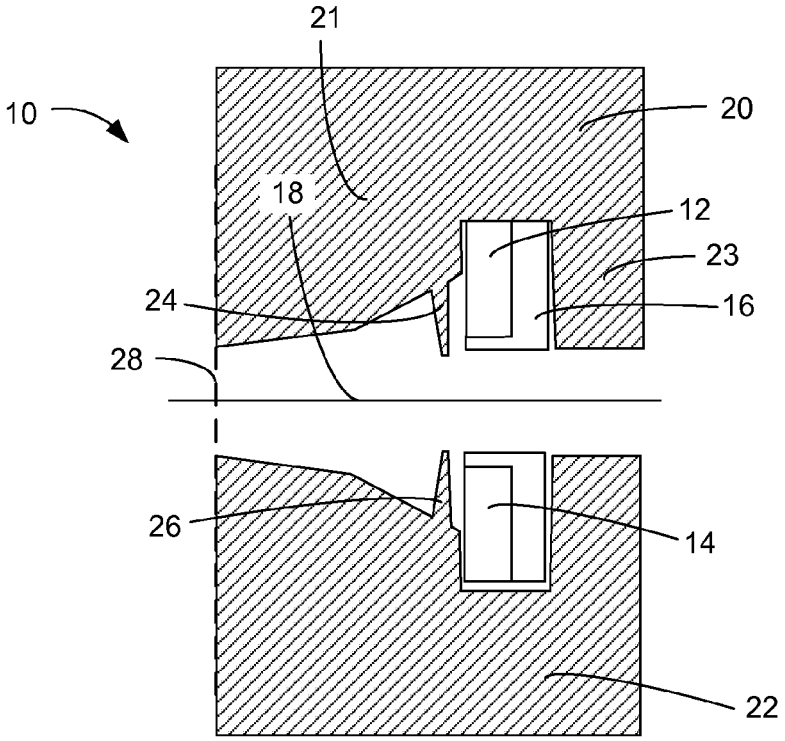
FIG. 1 provides a sectional illustration of an existing approach for a synchrocyclotron (K250) with iron for field shaping and shielding.

In the accompanying drawings, like reference characters refer to the same or similar parts throughout the different views; and apostrophes are used to differentiate multiple instances of the same or similar items sharing the same reference numeral. The drawings are not necessarily to scale, emphasis instead being placed upon illustrating particular principles, discussed below.

DETAILED DESCRIPTION

The foregoing and other features and advantages of various aspects of the invention(s) will be apparent from the following, more-particular description of various concepts and specific embodiments within the broader bounds of the invention(s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise defined, used or characterized herein, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially, though not perfectly pure, as practical and imperfect realities may apply; e.g., the potential presence of at least trace impurities (e.g., at less than 1 or 2%, wherein percentages or concentrations expressed herein can be either by weight or by volume) can be understood as being within the scope of the description; likewise, if a particular shape is referenced, the shape is intended to include imperfect variations from ideal shapes, e.g., due to manufacturing tolerances.

Although the terms, first, second, third, etc., may be used herein to describe various elements, these elements are not to be limited by these terms. These terms are simply used to distinguish one element from another. Thus, a first element, discussed below, could be termed a second element without departing from the teachings of the exemplary embodiments.

Spatially relative terms, such as "above," "below," "left," "right," "in front," "behind," and the like, may be used herein for ease of description to describe the relationship of one element to another element, as illustrated in the figures. It will be understood that the spatially relative terms, as well as the illustrated configurations, are intended to encompass different orientations of the apparatus in use or operation in addition to the orientations described herein and depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly.

Further still, in this disclosure, when an element is referred to as being "on," "connected to" or "coupled to" another element, it may be directly on, connected or coupled to the other element or intervening elements may be present unless otherwise specified.

The terminology used herein is for the purpose of describing particular embodiments and is not intended to be limiting of exemplary embodiments. As used herein, singular forms, such as "a" and "an," are intended to include the plural forms as well, unless the context indicates otherwise. Additionally, the terms, "includes," "including," "comprises" and "comprising," specify the presence of the stated elements or steps but do not preclude the presence or addition of one or more other elements or steps.

I) Magnetic Shielding

In a first embodiment of the apparatus and methods, the iron yoke and pole structure 20, 22 used in a conventional cyclotron is replaced by superconducting magnetic-field-shielding coils 30, i.e., coils formed of a material that is superconducting and operating at a temperature of ~4 K (for a low-temperature superconductor), ~20 K (for $MgB_2$) or 30-50 K (for a high-temperature superconductor) to magnetically shield the surrounding environment from the cyclotron field. Magnetic shielding is employed, for example, for medical cyclotrons used for patient treatment via proton radiotherapy, especially when the cyclotron is close to the patient. Magnetic shielding is also used for cyclotrons used for the manufacturing of isotopes, which operate in close proximity to medical technicians. In a clinical environment, the cyclotron's magnetic fields must decrease rapidly away from the device to minimize stray field effects. It is also advantageous to decrease the magnetic field away from the cyclotron for other non-patient applications to minimize access requirements or to enable location of cyclotrons close to magnet-sensitive equipment.

There are a variety of embodiments for decreasing the stray field with one or more sets of superconducting coils. Two possible embodiments of this feature are presented herein to illustrate the concept. The first embodiment utilizes a single layer of magnetic-field-shielding coils 30 to quickly reduce the intensity of the magnetic field surrounding the cyclotron 11, while the second embodiment considers the use of multiple layers 30, 40 of magnetic-field-shielding coils.

A) Single-Layer Magnetic Shielding

The first embodiment of the feature uses a set of coils 30 with current flowing generally in the direction opposite to the current-flow direction in the primary coils 12, 14 of the cyclotron 11. This configuration can readily reduce the dipole field and higher-order magnetic field moments produced by the primary coils 12, 14. In this case, it is possible to have the stray magnetic field decay much faster with distance than the field decay rate for similarly dimensioned dipole coils.

Figure 2:
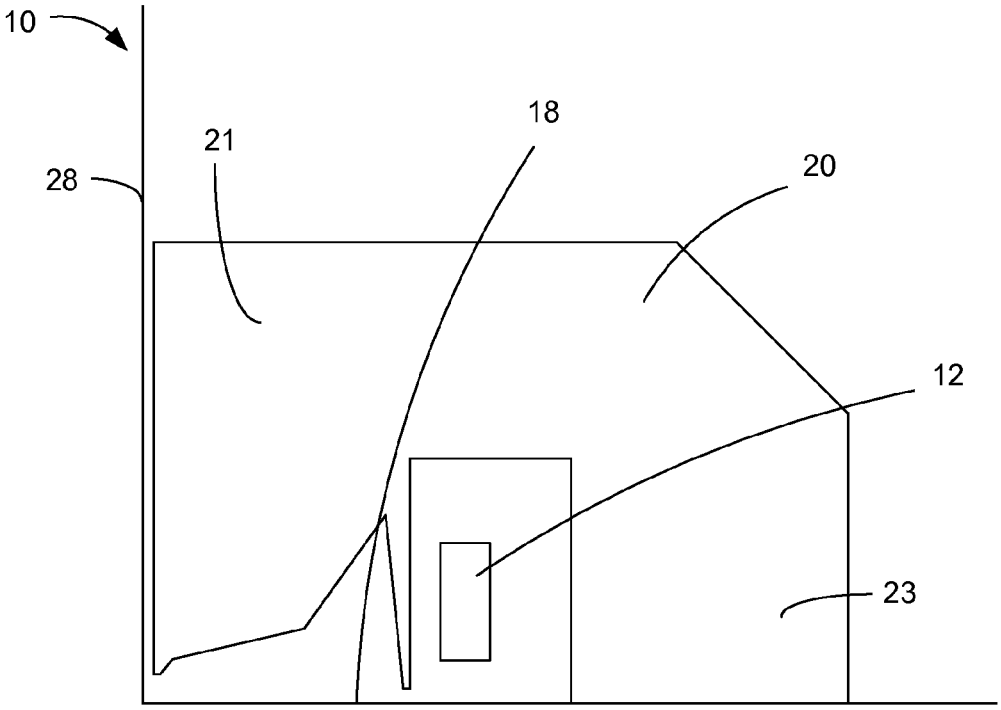
FIG. 2 provides another sectional illustration showing a primary coil and a top section of the yoke-and-pole structure of the cyclotron of FIG. 1.

FIG. 1 shows a schematic illustration of an existing approach to construct a high-field superconducting cyclotron 11, as described and illustrated in U.S. Pat. No. 7,541,905 (Timothy Antaya, "High-field superconducting synchrocyclotron") and in U.S. Pat. No. 7,656,258 (T. Antaya, A. Radovinsky, J. Schultz, P. Titus, B. Smith, L. Bromberg, "Magnet structure for particle acceleration"). This earlier approach, which was embodied in the "K250 cyclotron", combines a single pair of high-field superconducting coils with a massive ferromagnetic yoke 23 and ferromagnetic pole 21 pieces to generate, shape, and confine the cyclotron field. Worked examples in this document will compare embodiments of the invention against corresponding results for the conventionally designed K250 cyclotron, which is schematically illustrated in FIG. 2, showing the cyclotron midplane 18, iron (yoke and poles) 20, 22 and primary coil 12.

Coils 12 and 14 in FIG. 1 are wound on structural elements (bobbins) 16 and 17 and represent the primary coils 12, 14 for a cyclotron 10, which produce magnetic field at the midplane 18 as well as stray fields away from the cyclotron 10. The beam chamber is located at the midplane 18 of the cyclotron 10, and the cyclotron 10 is centered about a central axis 28. A sectional view of the primary coil 12 and the yoke-and-pole structure 20 in the top section of the cyclotron 10 is shown in FIG. 2. The magnetic yoke-and-pole structures 20 and 22 are used to increase the magnetic field at the midplane 18 of the cyclotron 10, and to shape the magnetic field in this region, while the outer return iron yoke 23 on each side of the midplane 18 shields the magnetic field away from the cyclotron 10. The fingers 24 and 26 are used for shaping the magnetic field in the region of the ion particle extraction. The use of iron is particularly effective at low fields, as the iron results in more-efficient field enhancement, field shaping, and magnetic-field shielding. At the higher magnetic fields needed for compact cyclotrons 10, the iron is driven over saturation, resulting in diminishment of its effectiveness.

Figure 3:
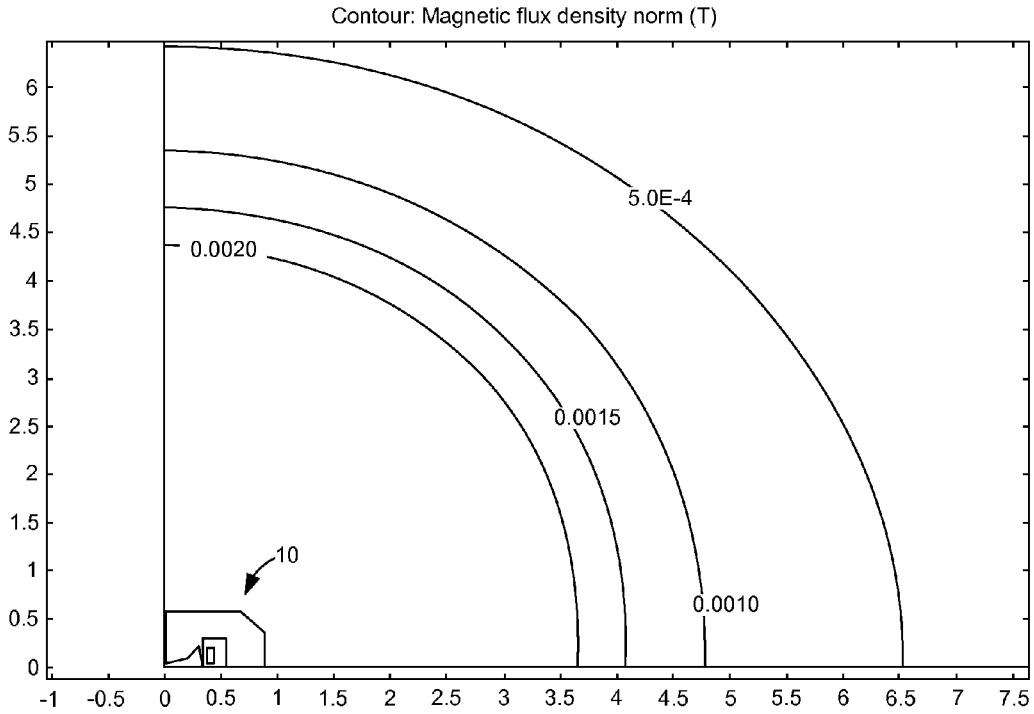
FIG. 3 is a plot of the contour of the 5, 10, 15 and 20 Gauss fields for a K250 synchrocyclotron (250 MeV proton beam, 9 T central field) with iron field shielding as a function of distance from the central axis and midplane (in meters); the plot includes an inset sectional illustration of the synchrocyclotron.

In the case of iron field shaping and shielding, the field profile contour of "substantial" field (defined as a field around 5-20 Gauss) is located substantially far away from the cyclotron 10. The 5-20 gauss contour for the conventional K250 cyclotron 10 with 250 MeV protons and with a 9 T central field is shown in FIG. 3 (in FIG. 3 and other Figures, distance indications on the axes are in meters).

Figure 4:
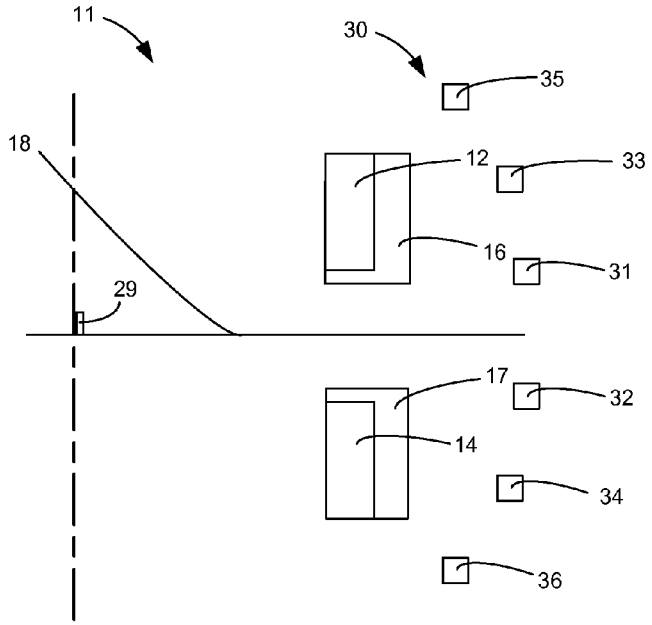
FIG. 4 is a schematic sectional diagram of an iron-free cyclotron with one set/layer of coils for shielding the magnetic field from a cyclotron.
Figure 5:
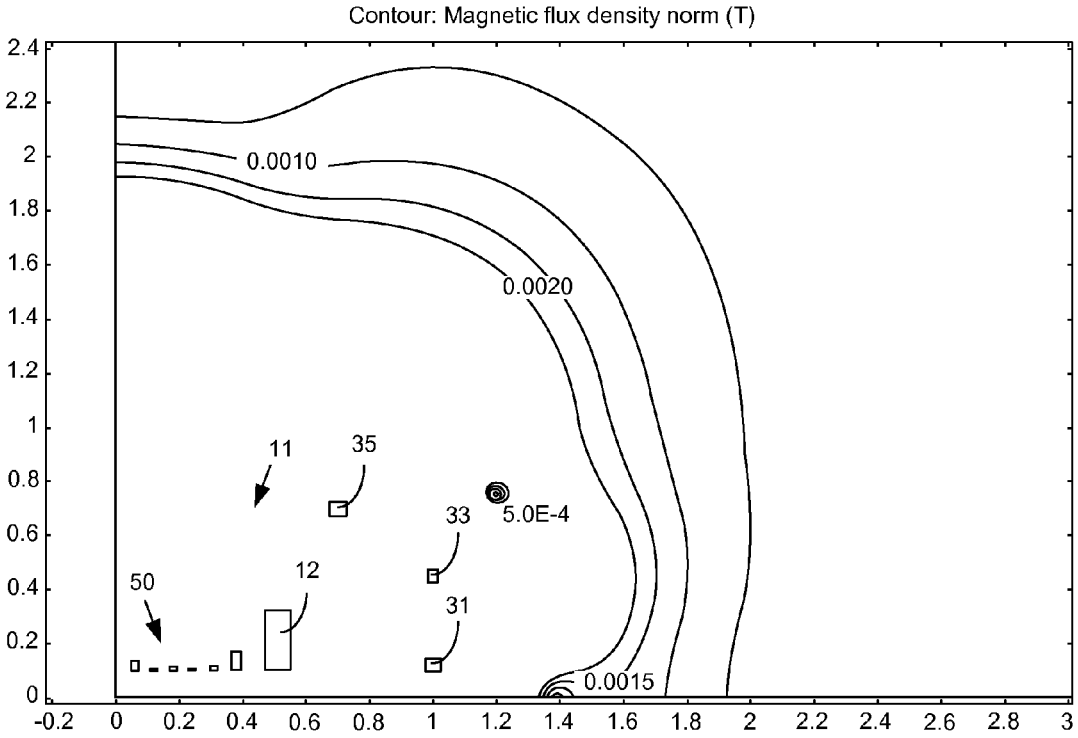
FIG. 5 is a plot of the contours of the 5, 10, 15 and 20 Gauss fields for an iron-fee synchrocyclotron as a function of distance from the central axis and midplane (in meters); the plot includes an inset sectional illustration of the synchrocyclotron, which includes a single layer of magnetic-field-shielding coils as well as magnetic-field-shaping coils.

FIG. 4 shows one embodiment of a cyclotron 11 where the iron for shielding is replaced by a single set (layer) 30 of superconducting magnetic-field-shielding coils 31-36. This configuration of magnetic-field-shielding coils 31-36 is referred to as single-layer shielding; multiple-layer shielding will be explored further below. We have performed calculations to illustrate the potential of the approach of using the single layer 30 of magnetic-field-shielding coils 31-36. For illustrative purposes, the single set 30 of magnetic-field-shielding coils 31-36 and the external magnetic-field profile are shown in FIG. 5, which shows the contours of 5, 10, 15, and 20 gauss fields using the field-profile requirements (in the midplane 18) that were calculated from the K250 cyclotron 10, shown in FIG. 3. In this case, all of the iron has been removed from the cyclotron design. In FIGS. 4 and 5, there is only one set of upper and lower primary coils 12, 14. The coil structural elements (bobbins) 16, 17, which support all of the coils in the system, are non-magnetic. In this case, the net dipole moment of the primary set of coils 12, 14 is approximately balanced by the net dipole moment of the magnetic-field-shielding coils 31-36, resulting in a very fast decay of the magnetic field with distance away from the cyclotron 11.

One issue addressed with the single-layer option, shown in FIGS. 4 and 5, is that the set 30 of magnetic-field-shielding 31-36 coils reduces the value of the magnetic field at the midplane 18 of the cyclotron 11, which is the principal region of interest in the design. To compensate for the reverse field due to the magnetic-field-shielding coils 31-36, the primary cyclotron coils 12, 14 are driven to higher fields (and potentially to higher currents). In the case where the cyclotron 11 is designed such that the primary field coils 12, 14 are close to the maximum allowed by the field-current-temperature limits (for a superconducting cyclotron 11), the reverse field from the magnetic-field-shielding coils 31-36 may result in a substantial increase in difficulty for the design of the primary coils 12, 14.

B) Multiple-Layer Magnetic Shielding

Figure 6:
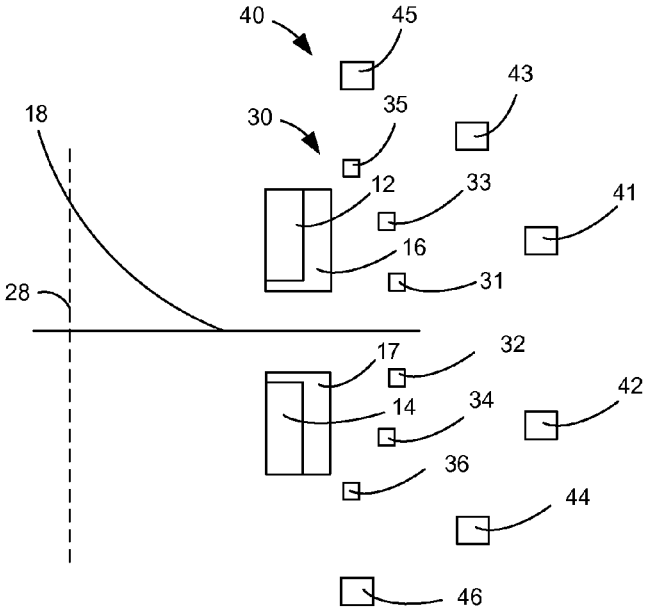
FIG. 6 is a sectional schematic diagram of an iron-free cyclotron with two sets of coils for shielding the magnetic field from a cyclotron.

One way to minimize the effect of the magnetic-field-shielding coils on the peak magnetic field produced at the primary cyclotron coils 12, 14 is to use two or more sets 30, 40 or "layers" of magnetic-field-shielding coils 31-36 and 41-46, as illustrated in FIG. 6 (shown for two layers). The currents in the coils 31-36 and 41-46 are targeted so that the net effect of the two sets 30, 40 of magnetic-field-shielding coils on the field on the midplane (i.e., the region of ion acceleration) inside the primary coils 12, 14 is small. In addition, the currents in the magnetic-field-shielding coils 31-36 and 41-46 are chosen so that the net dipole moment from the two sets 30, 40 of magnetic-field-shielding coils 31-36 and 41-46 balances the far-field magnetic field dipole moment from the primary cyclotron coils 12, 14. Although more coils are used and higher currents applied in this case, it is not necessary to increase the current/field of the primary cyclotron coils 12, 14, which are the most highly stressed coils in the assembly.

The return flux for the cyclotron 11 with two shielding layers 30, 40 is guided into the region between a first magnetic-field-shielding coil set 30, including coils 31, 33, and 35 and symmetrical magnetic-field-shielding coils 32, 34, and 36, and a second magnetic-field-shielding coil set 40, including coils 41, 43, and 45 and symmetrical magnetic-field-shielding coils 42, 44, and 46. In this embodiment, the current flowing in the first magnetic-field-shielding coil set 30 is in the same general direction as that in the primary cyclotron coils 12, 14, while the currents flowing in the second magnetic-field-shielding coil set 40 is in the general opposite direction from that in the primary dipole coils 12, 14 (i.e., if the flow in the primary coils 12, 14 is clockwise, the flow in the coils of the second magnetic-field-shielding coil set 40 is counter-clockwise).

Figure 7:
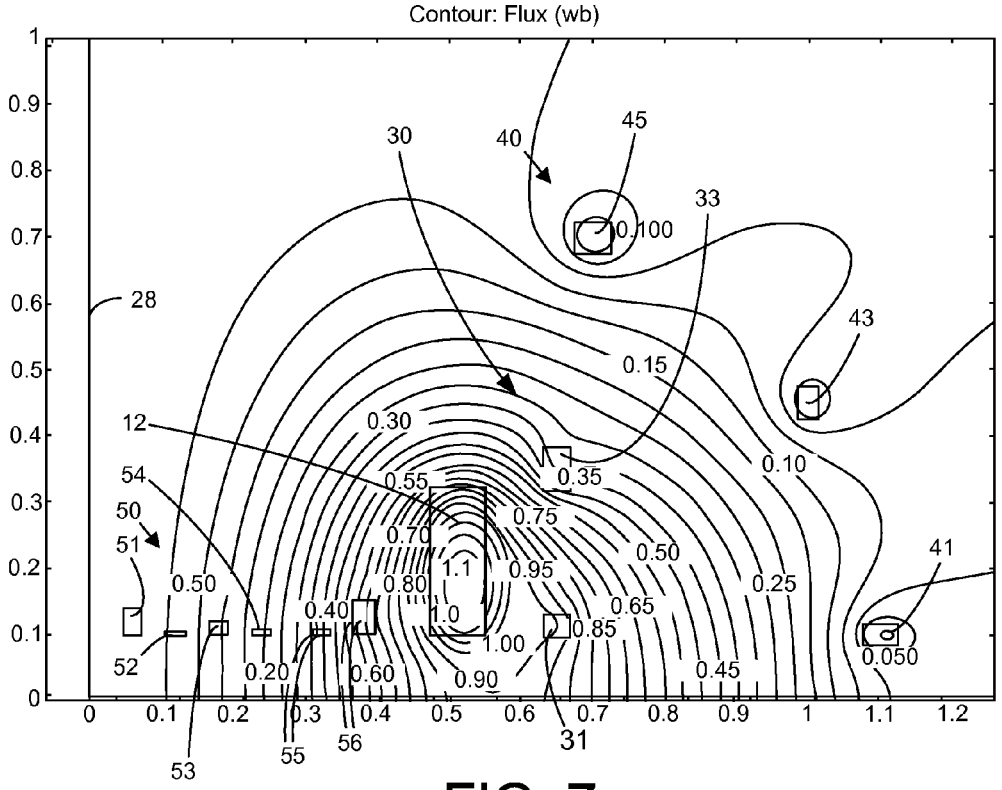
FIG. 7 is a plot of the magnetic flux (Wb) for an iron-fee synchrocyclotron with two sets/layers of magnetic-field-shielding coils and with magnetic-field-shaping coils as a function of distance from the central axis and midplane (in meters); the plot includes an inset sectional illustration of the synchrocyclotron.
Figure 8:
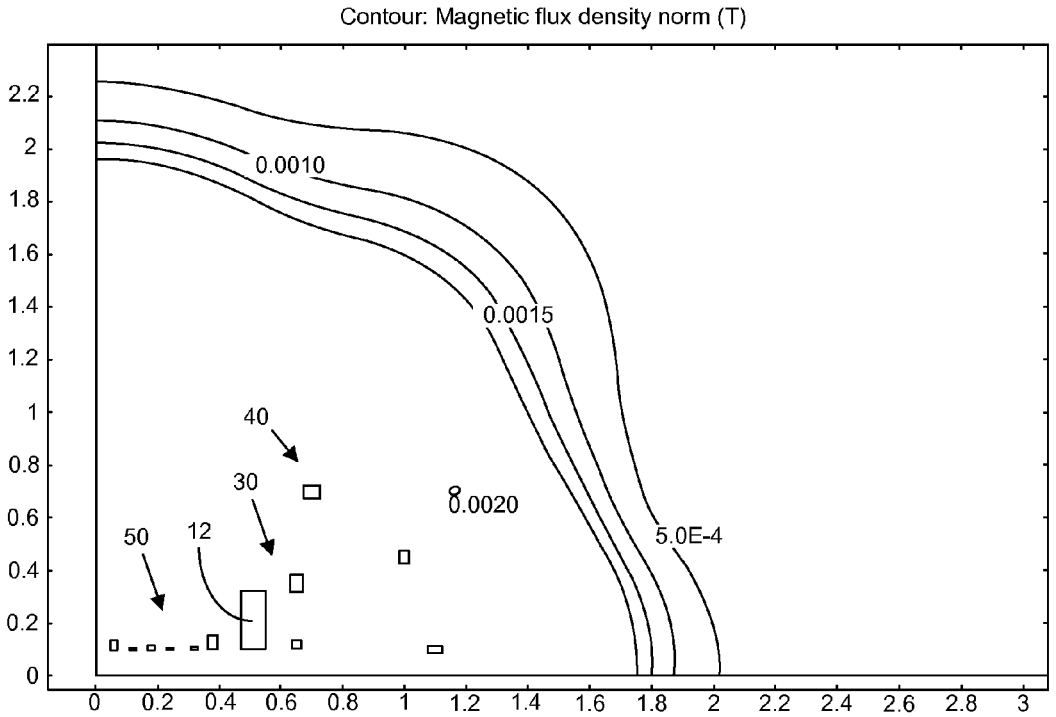
FIG. 8 is a plot of the contour of the 5, 10, 15 and 20 Gauss fields for an iron-fee synchrocyclotron with magnetic-field-shaping coils and two sets of magnetic-field-shielding coils as a function of distance from the central axis and midplane (in meters); the plot includes an inset sectional illustration of the synchrocyclotron.

FIG. 7 shows the magnetic field lines for the case with the two sets/layers 30, 40 of magnetic-field-shielding coils 31-36 and 41-46 and with field-shaping coils 51-56 (magnetic-field-shaping coils will be discussed later). Note that most of the flux from the beam chamber region is channeled through the two sets 30, 40 of magnetic-field-shielding coils 31-36 and 41-46. FIG. 8 shows a stray magnetic field, with contours for 5, 10, 15 and 20 Gauss shown, for the case of two sets/layers 30, 40 of magnetic-field-shielding coils 31-36 and 41-46.

These cases, which are not fully optimized, show an increased peak field in the case of the single-layer shielding 30 of about 0.1-0.2 T at the primary coils 12, 14 compared to the field generated in the two-layer shielding case.

Although we mentioned only dipole moment cancellation, it is to be understood that with multiple coils, it is possible to balance not only the dipole moment, but also higher order moments, resulting in an increased rate of decay of the field with distance from the cyclotron 11. For an $n^{th}$-multipole field, the field magnitude sufficiently away from the cyclotron 11 decreases as $B \sim 1/r^{n+1}$, so cancelling higher-order moments results in a faster rate of decay of magnetic field. In the case of symmetric sets of coils, n is even. If only the dipole field is cancelled, the next largest magnetic field moment is the quadrupole moment, which decreases as $1/r^5$. This process is applicable when the coils are axisymmetric. If there are errors in the coil axis (i.e., if the axes of the coils are not exactly aligned) or if the coils are not circular, there will be a stray magnetic field that decays more slowly. However, in practice, these errors are small; and the stray magnetic field in the region of interest is dominated by non-cancelling moments.

Near-optimized systems indicate that although the field is slightly higher in the primary coils 12, 14 in the case of a single set 30 of magnetic-field-shielding coils 31-36, the difference is not much (i.e., less than about 5%). However, the use of a single set 30 of magnetic-field-shielding coils 31-36 results in a lighter, simpler system.

This magnetic shielding technique may be used for all types of cyclotrons, including isochronous cyclotrons and synchrocyclotrons, although the illustrative calculations show representative results for synchrocyclotrons.

C) Non-Axisymmetric Magnetic Shielding

Although we have thus far described mostly axisymmetric multipoles (i.e., field components that are azimuthally symmetric), the technique is also useful for cancelling non-axisymmetric field components, such as, for example, those generated by the flutter field component required for isochronous cyclotrons. In this case, by making the coils non-axisymmetric, it is possible to cancel the flutter-like fields away from the cyclotron 11 by using either non-axisymmetric perturbations of the magnetic-field-shielding coils 31-36 and 41-46, described above (by making either radial or axial "bumps" on the coils) or by placing separate non-axisymmetric coils around the outmost layer of the magnetic-field-shielding coils of the cyclotron 11. Loops from coils that do not enclose the central axis 28 of the cyclotron 11 can be used to cancel the non-axisymmetric magnetic field modes. The loops can be oriented with axes that are parallel to the central axis 28 of the cyclotron 11, or perpendicular to it. The loops need not necessarily be circular. A method to determine the shape and current amplitude of the components is by expanding the field of the cyclotron 11 in spherical harmonics away from the cyclotron 11. Appropriately shaped and located loops can be used to cancel individual harmonic modes.

II) Magnetic Field Shaping Along the Acceleration Region of Cyclotrons

A second embodiment of the apparatus and methods is to use superconducting coils, rather than iron or other ferromagnetic materials, to shape the magnetic field profile needed for particle acceleration in synchrocyclotrons and in isochronous cyclotrons. Multiple sets of coils can be used to shape the field in the beam acceleration region.

In the case of synchrocyclotrons, the field in the beam chamber (shown in FIG. 18) of the cyclotron 11 needs to satisfy the following requirements for orbit stability. The value of the magnetic field needs to decrease with increasing radius, while keeping the value of the vertical (orthogonal to the midplane 18) oscillation frequency, $\nu_z$, and radial (in the midplane 18) oscillation frequency, $\nu_r$, within the following limits over the accelerating region: $0<2\ \nu_z<0.5\ \nu_r$, where $\nu_z=n^{1/2}$, $\nu_r=(1-n)^{1/2}$, and $n=-d\log(B)/d\log(r)$, where n is the weak-focusing field index parameter; and the magnetic field rises quickly with radius in the extraction region [see M. S. Livingston and P. Blewett, *Particle Accelerators*, McGraw-Hill (1962)]. B is the axial magnetic flux density on the midplane 18, and r is the radial location. At the extraction radius, $2*\nu_z=\nu_r$ and n=0.2; a weak-focusing cyclotron fails to achieve these conditions.

In synchrocyclotrons, the transient frequency of a beam bunch depends on the magnitude of the axial magnetic field at the radial location of the beam and the particle energy (due to relativistic effects). Thus, the frequency of the RF cycles varies during the beam acceleration.

Particular radial profiles of the axial magnetic field are required. The purpose of the next section is to demonstrate that adequate field shaping can be achieved by the use of electromagnetic coils instead of being shaped by iron or other ferromagnetic elements. We submit that, a priori, it was not obvious that it is possible to achieve the required field profiles solely by the use of electromagnetic coils for the case of the synchrocyclotron. Two illustrative examples of cyclotron 11 field shaping using superconducting coils 51-56 are presented. The first example shows that the magnetic-field profile for ion beam acceleration in a synchrocyclotron can be achieved solely by the use of superconducting coils. The second example considers the production of the magnetic-field profile using a combination of superconducting coils and a minimally sized iron pole tip.

A) Iron-Free Synchrocyclotron Field Generation

Set forth below is a determination of the electric current in a set 50 of magnetic-field-shaping coils and the location of the set 50 of field-shaping coils in a symmetrical array above and below the midplane 18 that provide a field profile similar to that of the conventional K250 cyclotron. The process of optimization assumed a constant gap between the upper and lower set of magnetic-field-shaping coils to allow clearance for the cryostat 70 and the cyclotron beam chamber. The coil dimensions were adjusted so that the current density in all of the field-shaping coils 51-56, as well as the primary coils 12, 14, was constant, as if the coils were connected in series and as if the same superconducting cable would be used in all coils, although, in general, this is not required. The location of the coils was adjusted in order to minimize the weight of the system. The dimensions and locations for the magnetic-field-shielding coils 31-36 were also adjusted to minimize the weight of the system and/or to minimize the maximum stray magnetic field far from the cyclotron 11. Other cyclotron parameters could also be selected for optimization, such as overall volume, mass of superconductor, stored magnetic field energy.

Figure 9:
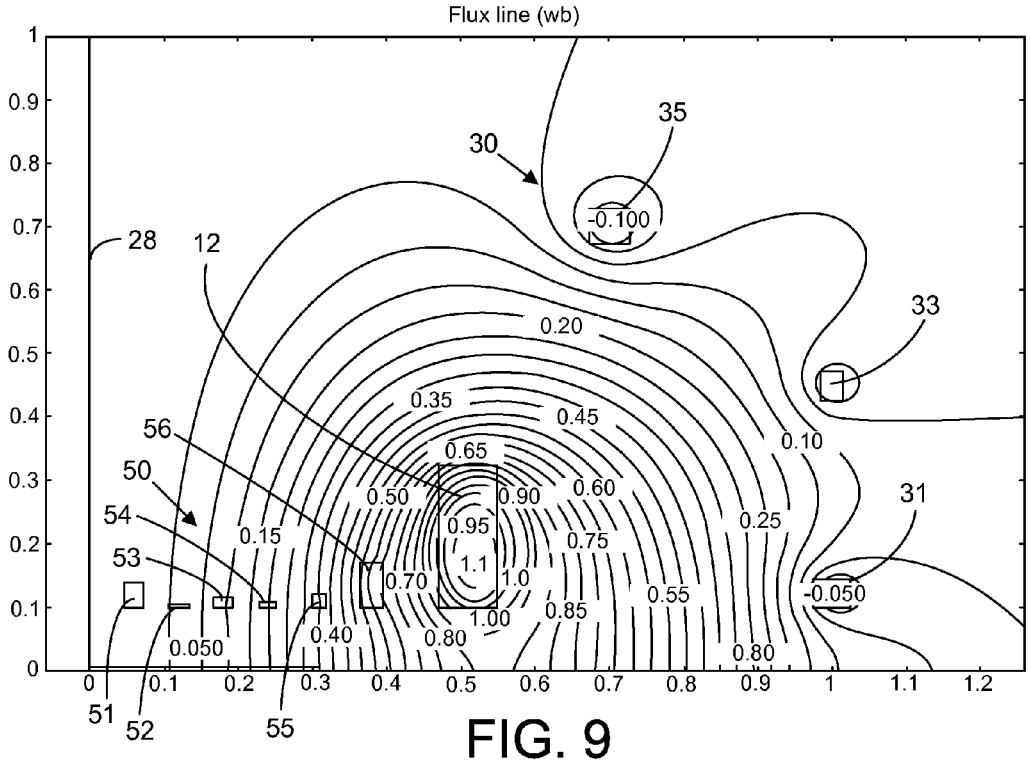
FIG. 9 is a plot of the magnetic field lines for an illustrative case duplicating the K250 cyclotron (with iron) field profile at the cyclotron midplane, but done without iron, corresponding to the illustrative model shown in FIG. 5.

The field profile in the midplane 18 of an iron-free version of the K250 cyclotron is provided in FIG. 9, wherein the magnetic field is generated by the set of coils also shown in FIG. 5. The magnetic-field-shaping coil currents for the design shown in FIG. 9 were not very large currents, or large opposing current. Indeed, the fact that relatively small currents, mostly flowing in the same direction can provide the field shaping required for the synchrocyclotron may be viewed as surprising.

Figure 10:
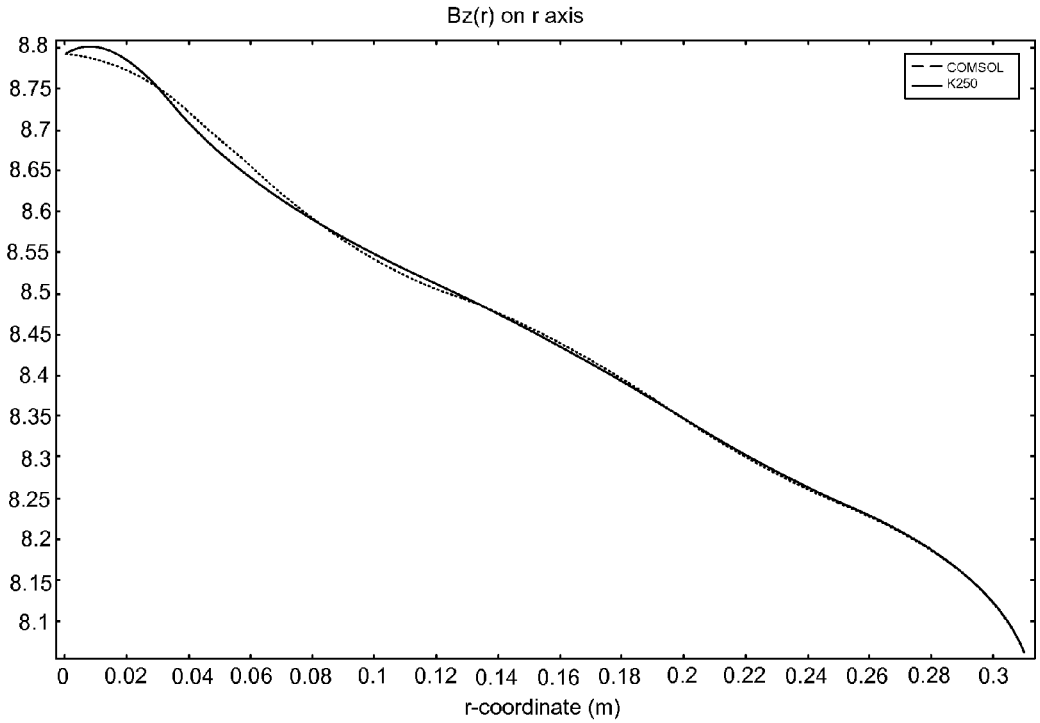
FIG. 10 is a plot of the field magnitude on the midplane for the case of a K250 cyclotron and that of an iron-free cyclotron, for the case corresponding with FIGS. 4 and 9.

FIG. 10 shows the magnetic field profile in the midplane 18 for the cases of the conventional K250 cyclotron (with iron) and for the case without iron (with magnetic-field-shaping coils 51-56 and one layer 30 of magnetic-field-shielding coils 31-36 and 41-46). One of the consequences of removing the iron is that it is possible to substantially increase vertical access for the beam chamber at the midplane 18 of the cyclotron 11.

For cyclotrons 11 where iron is used for shaping the field, it is difficult to provide sufficient shaping in compact cyclotrons 11 if the gap between the pole tips is large due to the fact that compact cyclotrons 11 run at high magnetic field, which saturates the iron and limits its effectiveness. In the case of a cyclotron 11 designed with a minimal amount of iron, the iron is provided only for shaping the field, with a large percentage of the fields being produced by superconducting coils 12, 14 and 51-56.

The coil sets 50 are up-down symmetric across the midplane 18. They can be positioned with sufficient accuracy to minimize the field errors; and as a consequence, they can be manufactured without the need of magnetic shimming, which substantially decreases the effort required in manufacturing the cyclotrons 11 since the shimming, due to inhomogeneous iron, is specific to a given cyclotron 11.

Figure 11:
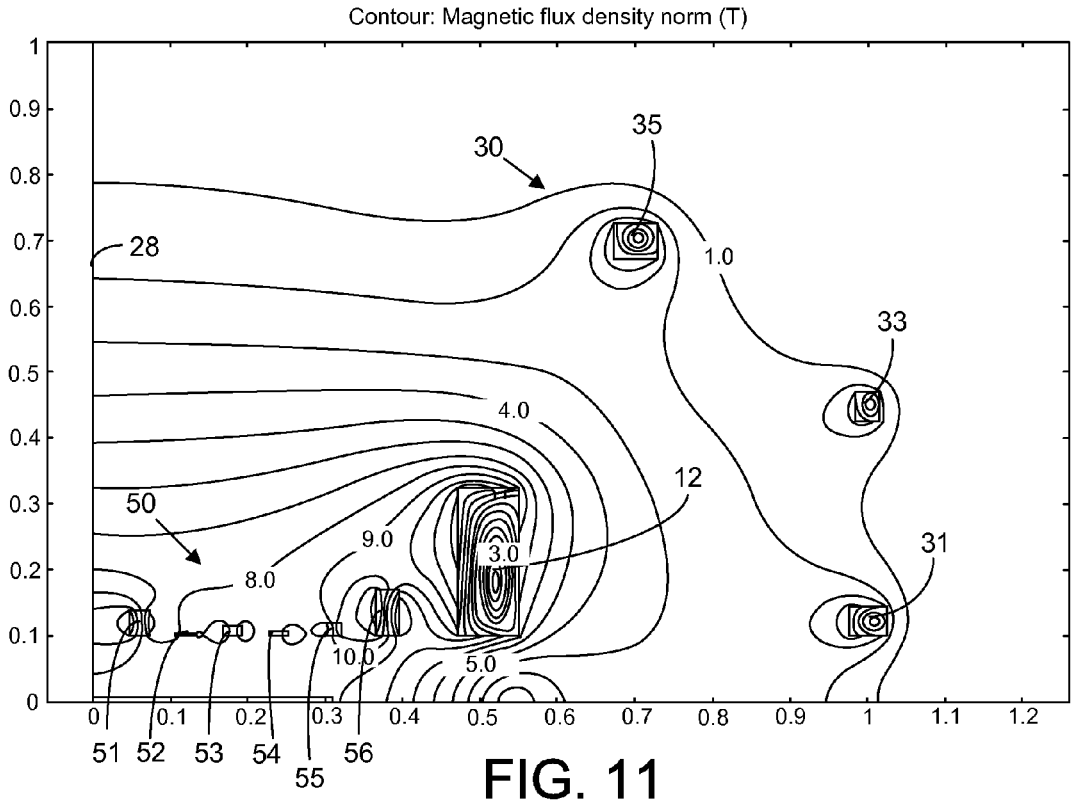
FIG. 11 is a plot of the contours of magnetic field for the case of a single set of magnetic-field-shielding coils and with magnetic-field-shaping coils corresponding to the cases shown in FIGS. 9 and 10.

FIG. 11 shows the contours of constant magnetic field for the case corresponding to that in FIGS. 9 and 10. The contour step (i.e., the change in magnetic-field amplitude between adjacent contours) is 1 T in FIG. 11. The primary coils 12, 14 have peak fields over 12 T. The field-shaping coils 51-56 have fields slightly smaller than the main field. The magnetic-field-shielding coils 31-36, on the other hand, have a field lower than about 5 T. Thus, the magnetic-field-shielding coils 31-36 are relatively simple, and the magnetic-field-shaping coils 51-56 are no more complex, in terms of current density/field, than the primary coils 12, 14.

B. Synchrocyclotron Field Generation Using Minimal Amounts of Iron

Figure 12:
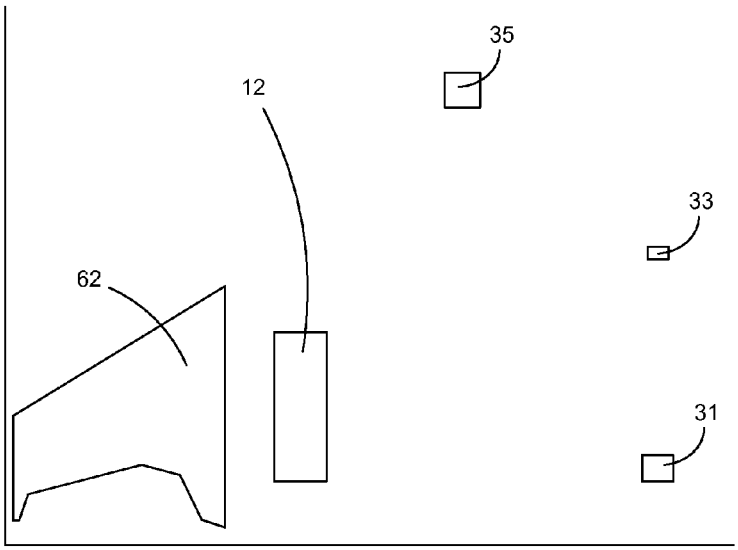
FIG. 12 is a section diagram of an Illustrative embodiment with iron for field shaping (for synchrocyclotron magnetic topology) and magnetic-field-shielding coils.
Figure 15:
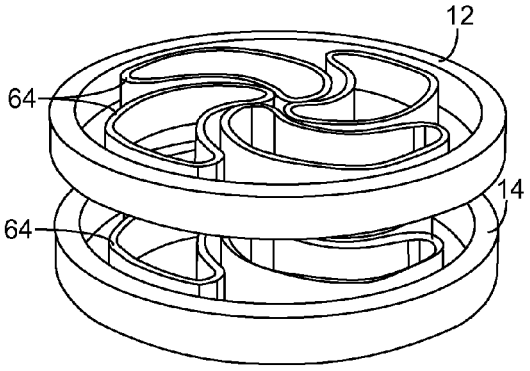
FIG. 15 is a perspective view of spiral coil windings in a magnet structure of an isochronous cyclotron for the shaping of azimuthal field bumps.
Figure 16:
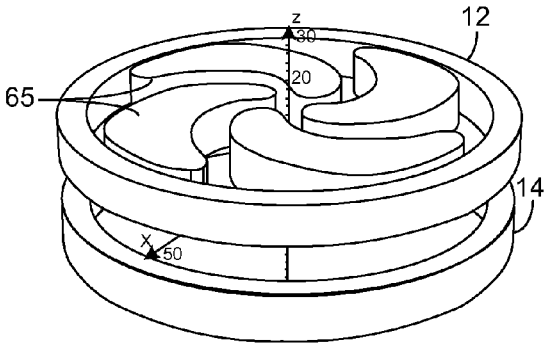
FIG. 16 is a perspective view iron pole pieces magnetized by the primary coils in a magnet structure of an isochronous cyclotron for the shaping of azimuthal field bumps.

In other embodiments, some iron may be positioned near the beam chamber to achieve some of the magnetic-field shaping while leaving the shielding to the set of magnetic-field-shielding coils 31-36. This is particularly true for isochronous cyclotrons, where it may be advantageous to retain the use of an iron pole tip 62 to generate the flutter field component required for beam stability, as shown in FIG. 16. Alternatively, the flutter field required for isochronous cyclotrons can be produced using sets of non-axisymmetric coils 64 placed in the bore of the primary coils 12, 14 to replicate the hills and valleys found on the iron pole tips 62 used for conventional isochronous cyclotrons, as shown in FIG. 15. FIG. 12 shows an illustrative model of a synchrocyclotron 11 that uses a small iron pole tip 62 and a single set/layer 30 of magnetic-field-shielding coils 31-36.

The shape of the iron pole tip 62 in FIG. 12 is not optimized and is only used for illustration. However, the magnetic field in the midplane 18 is the same or nearly the same as in the case of the conventional K250 cyclotron, which uses only iron and no magnetic-field-shielding coils, as shown in FIG. 2. We performed calculations for both single 30 and multiple 30, 40 sets/layers of magnetic-field-shielding coils; though, in FIG. 12, only one set/layer 30 of magnetic-field-shielding coils 31-36 is shown.

Figure 13:
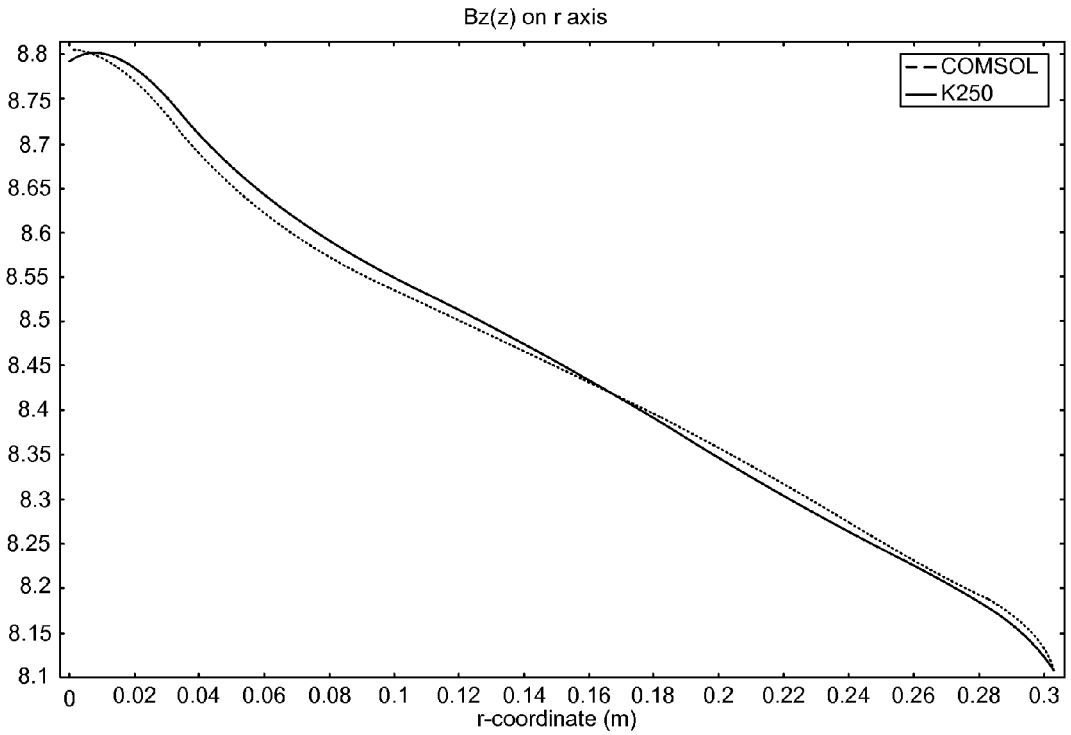
FIG. 13 is a plot of the magnetic field on the midplane, as a function of radius, for the cases of the K250 cyclotron and for the case with iron field shaping and magnetic-field shielding coil shown in FIG. 12.
Figure 14:
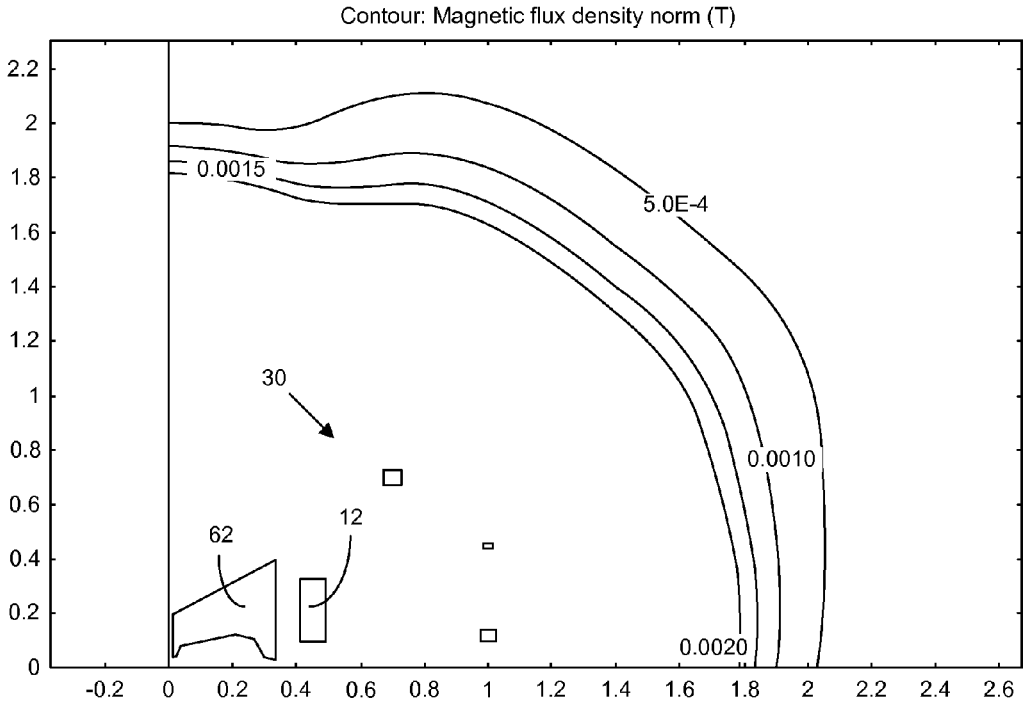
FIG. 14 is a plot of the contours of 5, 10, 15, and 20 Gauss fields for the case with iron for magnetic-field shaping and coils for magnetic-field shielding, corresponding to the embodiments of FIGS. 12 and 13.

The magnetic field in the midplane 18 for the case with iron field shaping and magnetic-field shielding coils corresponding to FIG. 12 is shown in FIG. 13. Meanwhile, FIG. 14 shows the contours of constant stray magnetic field as a function of distance from the cyclotron 11 (in meters); specifically, the contours of 5, 10, 15, and 20 Gauss fields are plotted.

The gap in the midplane region is larger for the case that uses magnetic-field-shaping coils 51-56 (i.e., 10 cm in the illustrative cases shown in FIGS. 5 and 7-11) than for the case with the iron (i.e., about 5 cm half-height gap).

Note that the 5-Gauss region is slightly larger in the illustrative case of the iron field-shaping/magnetic-field-shielding coils case (shown in FIG. 14) than in the case of coil shaping with coils 51-56 and a single set 30 of magnetic-shield coils 31-36, shown in FIG. 5. In the cases of FIGS. 10 and 13, the beam-stability requirements for the beam are satisfied for both the K250 cyclotron and for the iron field-shaping, magnetic-field-shielding coils cyclotron 11 of FIG. 12. We have also looked at the implications of using a magnetic cryostat 70 to contain the shaping coils 51-56 and magnetic-field-shielding coils 31-36. We have concluded that the impact on the magnetic-field shielding of the cyclotron 11 using a magnetic cryostat 70 (i.e., iron) is small.

III) Features Enabled by the Iron-Free or Reduced-Iron Cyclotron Design

The use of multiple superconducting coil sets 30, 40 for the magnetic field-shielding of cyclotrons 11, as well as for generating the field profiles required for isochronous cyclotrons and synchrocyclotrons, effectively eliminates or substantially reduces the use of ferromagnetic materials, such as iron poles 21 or yokes 23, in these cyclotrons 11. The elimination of iron from cyclotron 11 designs yields multiple benefits, which will be discussed in the following sections.

A) Weight Reduction

The elimination of the shielding iron from a cyclotron 11 design allows for a very large decrease in the weight of the cyclotron 11, as the weight of the coils, support structure, and cryostat used to replace the iron yoke-and-pole structure 20, 22 is a small fraction of the weight of the shielding iron that they replace. A partially optimized set of parameters to illustrate this trade-off is shown in Table 1. For reference, the weight of the conventional K250 magnet is about 20 tons.

TABLE 1

[weight of magnetic elements (i.e., coils, iron and cryostat) for different designs for a K250-compatible synchrocyclotron (tons)]:

| | Two sets of shielding coils | Single set of shielding coils |
|---|---|---|
| Shaping Coils | 3.2 | 2.9 |
| Shaping Iron | | 2.5 |

The weight of the cryostat 70 is included in Table 1; and in the case of magnetic-field-shielding coils 31-36, the outer cryostat 70 weight increases substantially to accommodate the magnetic-field-shielding coils 31-36.

To facilitate the direct replacement of a conventional cyclotron with an iron-free equivalent, it is important to limit the placement of the outermost layer 30/40 of magnetic-field-shielding coils 31-36/41-46 approximately to the same locations as the edges of the iron yoke 23 that they replace (so that the system volume, itself, is not larger). This consideration greatly simplifies the installation of the iron-free cyclotrons 11 in systems that require transportability, gross movement or rotation of the cyclotron 11. For clinical ion radiotherapy, significant advantages are obtained by placing the cyclotron 11 on a gantry that rotates, as described in U.S. Patent Application 2010/0230617 (K. Gall, "Charged Particle Radiation Therapy") and in U.S. Pat. No. 8,053,746 (J. H. Timmer, et al., "Irradiation Device").

Indeed, if the weight of the cyclotron 11 is small enough, the cyclotron 11 may be placed on a robotic articulated arm instead of on a rotating gantry. Installation of a cyclotron 11 on a robotic arm would significantly increase the flexibility of placement of the device around a patient or around an object that is being interrogated or irradiated. Custom gantries for conventional, iron-shielded cyclotrons for use with patients are expensive and require heavy counterweights. The lightweight iron-free cyclotrons 11, described herein, can be used in a portable arrangement, such as an ion-beam radiotherapy treatment room on a mobile platform, such as a truck. Modular arrangements can be manufactured and tuned in the shop and shipped for the final installation at the point of use.

B) Portability

In the case of a highly portable cyclotron 11, the system weight is advantageously minimized. Current leads can be eliminated, using either persistent or near-persistent superconducting coils with removable current leads, or by inductively charged units. In the case of inductively charged units, the charging magnetic field is substantial. Inductively charged superconducting magnets have been used at Massachusetts Institute of Technology in the Levitated Dipole Experiment (LDX), using a superconducting charging coil [A. Zhukovsky, et al., "Charging Magnet for the Floating Coil of LDX," 11 *IEEE Transactions on Superconductivity* 1873 (2001)].

For example, extremely lightweight, highly portable cyclotrons have been considered for interrogating objects from airborne platforms (see U.S. Pat. No. 7,970,103, M. Hynes, et al., "Interrogating hidden contents of a container").

Alternatively, current leads can be used to actively power the cyclotron 11. The current leads can be low-temperature or high-temperature superconductors or $MgB_2$ in a cryostat remote to the cyclotron 11 that connects the fixed current leads and the cyclotron 11. The heat load to the superconducting device is small. By using high-temperature superconductor (HTS) leads, the refrigeration requirements to remove the thermal load at the low temperature are minimized. The heat load due to the resistive elements between the room-temperature contacts and the superconductor leads is removed from the cryogenic environment remotely to the cyclotron 11 in a fixed location.

For some applications, continuous cryogenic cooling is provided to the unit for long-term operation of the cyclotron 11. In this case, the use of interconnects does not increase the design complexity, avoiding the need of inductively charging of the cyclotron 11.

C) Variable Energy Acceleration in a Single Cyclotron

An advantageous feature that is facilitated by the development of iron-free cyclotrons 11 (either synchronous or isochronous) is the capacity for energy variation. Changing the energy of the beam is made possible by several modifications to the cyclotron operation, some of which are enabled by the use of iron-free cyclotrons 11. Changing the energy of the beam, while maintaining the radius of extraction requires a change in the magnetic field of the cyclotron 11. Because there is no iron (or very little iron), the magnetic-field magnitude, but not the normalized-field gradient (measured as 1/B grad B) can be changed by just scaling the currents in all of the coils by the same factor. Alternatively, there can be more than one set of current leads, where not all of the coils are connected in series, allowing for changing the coil currents and thus magnetic field magnitude and distribution.

The relativistic gyro-radius, $r_{gyro}$, of a charged particle in a magnetic field is $r_{gyro}=\gamma m\ v/q\ B$, where $\gamma$ is the relativistic mass correction, m is the rest mass of the charged particle, v its velocity, q its charge and B the magnitude of the magnetic field. The energy of a particle is given by $E=mc^2(\gamma-1)$, where c is the speed of light. For non-relativistic particles, $E=\frac{1}{2}\ m\ v^2$, and the gyro-radius is given by $r_{gyro}=(2\ E\ m)^{1/2}/qB$. For a constant radius of extraction, the energy of the particle scales as $E\sim B^2$. Thus, relatively small changes in the magnetic field result in substantial changes of the beam energy.

The focusing characteristics of the synchrocyclotron magnet are fully defined by the dimensionless parameters [i.e., index, n(r); betatron frequencies, $\nu_z(r)$ and $\nu_r(r)$; and all functions of the dimensionless radius, $r=R/R_{ex}$]. The magnetic field profile of an iron-less synchrocyclotron 11 can be scaled by the simultaneous proportional change of the current density, j, in the coils of the magnet. The coils may or may not be connected in series. When the coils are connected in series, there is one pair of current leads; and all coils carry the same operating current, $I_{op}$. The required field variation can be simply achieved by changing $I_{op}$. The field profile, B(R), linearly scales with the coil current density, keeping the dimensionless focusing characteristics of the cyclotron 11 unchanged.

Scaling of the acceleration-field intensity permits ion acceleration from the minimum energy permitted by other subsystems of the cyclotron 11 (e.g., the ion source, RF system, beam extraction system) to the maximum permitted by the coil design. In an iron-free cyclotron 11, the beam energy can be adjusted continuously by varying the coil system current, $I_{op}(t)$, as a function of time.

For some applications, including ion-beam radiation therapy, it would be useful to modulate the energy of the beam. This feature is enabled by the variation of the field in an iron-less cyclotron 11.

Changing the magnetic field rapidly takes substantial power. For the case of the K250 cyclotron, a typical number for the stored magnetic-field energy is 25 MJ. Assuming a time of one minute for changing the field by 20%, the power required is ~100 kW. Because of the limited rate of change of the magnetic field, the scanning of the beam will be such that the beam is scanned longitudinally through the tissue, while the beam energy is slowly varied. This variation can be performed in distinct energy steps with the magnitude and range determined by the width of the Bragg peak.

The rapid change in magnetic field can deposit substantial heat in the coil winding due to AC losses in the winding, both magnetization and coupling, depending on the rate of change of the field. The magnets are designed with large temperature and energy margins in order to survive the heating. Thus, coils (such as those formed of high-temperature superconductors) with a high critical temperature are advantageous.

In addition, cooling is provided for the magnet. Suitable coolants include liquid and gaseous helium, or without coolants by thermal conduction directly to the cold stage head of a cryocooler. In a radiotherapy application, the magnet can be re-cooled between irradiation procedures. For other applications that do not require a rapid change of energy, this problem can be eliminated by slow ramping.

The second operational change when changing the beam energy is the adjustment of the frequency of the RF cycles. For non-relativistic particles, the frequency scales linearly with the field (f~B). The RF circuits in synchrocyclotrons are designed to have substantial bandwidth to accommodate the change in magnetic field. In the case of the isochronous cyclotron, the magnetic field is tuned to the resonant frequency of the particles. In the case of the synchronous cyclotrons, the range of frequencies is adjusted. The range of frequencies scales with the magnetic field—that is, the lower frequency scales with the magnetic field, and the highest frequency also scales with the magnetic field. Thus, the total range of tunable frequencies of the RF circuit for the synchrocyclotron goes from the lowest frequency at the lowest field to the highest frequency at the highest fields. There is, however, a fast frequency ramp (for a given field) and a slower change associated with the changing magnetic field.

Large energy selectivity can be achieved by the use of multiple accelerating gaps with individual control. The process can be used either with RF cavities for the acceleration, as well as for dee's. In order to achieve a lower acceleration energy with the beam rotating around the cyclotron 11 at lower frequencies, a cavity or a dee can be de-activated and thus prevent deceleration of the beam (instead of reducing the frequency). There would be multiple RF cycles per beam rotation, but only a few limited gaps would be activated in order to continue the acceleration. If the other cavities would be activated, the beam would decelerate while traversing the cavity or traversing the gap between the de-activated dees, which would thus be counterproductive. By deactivating the decelerating cavities or dees it is possible to maintain the frequency higher than would otherwise be required, limiting the required bandwidth of the accelerating RF cycles. It should be noted that when the acceleration of the beam takes place in only a fraction of the RF cycles, it would be possible to accelerate multiple beam bunches. The number of potential beam bunches is the same as the number of RF cycles per orbit of the charged particles.

In addition to changing the beam energy, it is possible to adjust the field and RF frequency to accommodate the acceleration of different ion species in a single cyclotron 11. The resonant frequency of the ions depends on the charge to mass ratio of the ions, and to a lesser extent on the energy (if relativistic), and thus as the ions are changed, it is necessary to adjust the frequency of the RF cycles. It is thus possible to accelerate hydrogen, deuterium or carbon in the same cyclotron 11, but not all of these simultaneously. In the case of carbon, the acceleration of $C^{6+}$ is advantageous, as $C^{6+}$ has an accelerating RF frequency similar to that of deuterium because it has the same charge-to-mass ratio.

Thus far, the discussion has focused on the acceleration of charged particles (ions). In a cyclotron 11, moreover, the particles must be introduced to the acceleration region, where they can accelerate outward in the midplane 18, and to extract them. Conventional methods using spiral inflectors for particle injection from external ion sources are readjusted with the changing magnetic field. A way of adjusting the parameters so that the spiral inflector is effective as the magnetic field is changed is to simultaneously adjust the injected beam energy and the electric field in the inflector. If the magnetic field changes by $\eta$, the electric field by $\eta^2$ and the injected beam energy by $\eta^2$, then the spiral inflector will be effective in introducing the charged particles in the cyclotron 11, even though the magnetic field has changed.

Similarly, it would be difficult to accommodate the injection with a spiral inflector of charged particle beams with a different charge-to-mass ratio or energy when the amplitude of the magnetic field in the cyclotron 11 is changing. By adjusting the energy of the injected particles and the amplitude of the electric field, particles with different charge-to-mass ratios through the same inflector may be introduced with adequate efficiencies.

A simpler solution for admitting particles with different energies or different charge-to-mass ratios is to use an electrostatic mirror. Yet another alternative is the use of an internal ion source. An internal source is impractical for the case of the carbon 6+($C^{6+}$) ion. In still another embodiment, one may couple an electron-beam ion trap or an electron-beam ion source (EBIT/EBIS) with the cyclotron 11.

One option for extraction of the beam is the use of magnetic perturbations in the acceleration chamber, where the magnetic field is produced by a ferromagnetic element, a superconducting monolith, or a wound coil that can be programmed to extract the beam at the desired energy level.

D) Radiation Production and Shielding

Due to losses from the high-energy beam both during acceleration and extraction, neutron and gamma radiation is generated that may need to be shielded, especially in a clinical environment. Because the designs described herein eliminate a substantial mass of shielding material that would otherwise surround a conventional cyclotron, it is possible to use lighter and more-effective shielding materials than iron, placed close to the device, for improved radiation shielding performance. Radiation shielding may be useful for applications with long-term exposure (such as for operators of the cyclotron) or for cyclotrons with high beam currents (and thus high power). For gamma radiation, high-Z materials are advantageous. For neutrons, light materials with substantial concentration of hydrogen atoms are advantageous. Water, hydrocarbons, plastics and other light materials, mixed with a neutron absorber, such as boron, can be used with better radiation-shielding properties than iron. In radiation-treatment rooms, radiation shields can be installed around the cyclotron 11 on the gantry or on the stationary wall separating the gantry from the patient space. However, there are advantages in terms of materials if the radiation source is shielded near the source.

In an iron-free cyclotron 11, the replacement of the bulky iron poles 21 and yoke 23 by relatively simple and open inter-coil structures results in a substantial amount of open volume near the superconducting coils inside the cryostat 70, which can be filled with nuclear radiation shielding material.

E) Superconducting Coil Optimization

Some of the coils in an iron-free cyclotron 11, and in particular the magnetic-field-shielding coils 31-36 and 41-46, can be made from different types of superconductors. For the case in FIG. 9, with fields shown in FIG. 11, the peak field in the magnetic-field-shielding coils 31, 33 and 35 is less than 6 T. At this level of field, NbTi superconductor can be used for the shield coils. By comparison, the magnetic-field-shaping coils 51-56, including the primary cyclotron coils 12, 14, have fields on the order of 9-12 T for the illustrative example of FIG. 9. Thus, the set 50 of magnetic-field-shaping coils 51-56 and the primary coils 12, 14 can be made from higher-performance superconductors, such as $Nb_3Sn$, or from high-temperature superconductors, such as $YBa_2Cu_3O_2$, (YBCO). However, the magnetic-field-shielding coils 31-36 and 41-46 can be made from the inexpensive NbTi superconductor or even $MgB_2$ operating at higher temperature. Under certain circumstances, it may be desirable to use resistive magnetic-field-shielding coils placed outside of the primary coil cryostat 70, such as when it is desirable to minimize the size and, hence, cryogenic heat loads on the primary coil cryostat 70, or to limit the energy stored in the superconducting coil set, for quench protection purposes.

There are a large number of coils in the case of a cyclotron 11 with magnetic-field-shielding coils 31-36 and 41-46 and/or magnetic-field-shaping coils 51-56. There are two potential methods of powering the coils. The coils can be driven electrically in series, with a single set of current leads. This mode provides the lowest cryogenic heat load, dominated by the current leads. However, by using multiple sets of current leads increased flexibility can be provided in adjusting the currents in the different coils. Different circuits are useful in the process of optimizing the performance of the cyclotron 11. However, once one cyclotron 11 has been optimized, further units can be built with a single circuit. Trimming coils, at either room temperature or at cryogenic temperature inside the cryostat 70 can be used to slightly modify the field in mature-design cyclotrons, if needed.

The current in the cyclotron coils can be high if multi-strand, superconducting cables are used, allowing quench protection by external energy extraction. Alternatively, a small current can be used, requiring internal energy dump for quench protection. There are several ways of providing internal quench. First, internal heaters in the coils can be energized to initiate a large normal zone in the coils. Second, subdivision of the winding circuit by use of parallel cold diodes can also be used to better distribute the magnetic stored energy during a quench throughout the coil and minimize the local hot-spot temperature. Alternatively, AC heating can be used, as suggested by inductive quench for magnet protection, as disclosed in U.S. Pat. No. 7,701,677 (J. Schultz, L. Myatt, L. Bromberg, J. Minervini, and T. Antaya, "Inductive quench for magnet protection"). One can use AC quench by placing quench-inducing coils that have zero mutual inductance with the superconducting coil set. Because there are multiple coils, providing coils that have zero mutual inductance can be achieved with a wide range of coil or coils locations. By energizing the quench-inducing coils with an AC current, the required reactive power can be reduced (without any effect on the primary coil currents), while at the same time generating AC fields in the superconducting coils. The heating from the AC fields drives the superconducting coils normal, thus resulting in an internal energy dump. Different coils or coil sets can have different quenching mechanisms, with some coils having an external energy dump, and the other coils having an internal energy dump.

The use of an internal energy dump for protection, either by using eddy-current quench or by imbedded heaters, allows for low-current operation. Low current is attractive in that the cryogenic loses are dominated by the current leads, and these cryogenic losses are reduced by low-current operation.

The cyclotron superconducting coils (magnetic-field-shaping coils 51-56 and/or magnetic-field-shielding coils 31-36 and 41-46) can be cooled by a bath of liquid helium or by conduction cooling to plates that are cooled by flowing helium. Supercritical helium can be used because it is advantageous to use a single-phase fluid in cyclotrons 11 that change orientation with respect to gravity. Another method of cooling is by conduction only, without the use of gas or liquids, by direct thermal coupling to the cold stage of a cryocooler. This approach has the advantage of zero liquid boil-off and elimination (or reduction) of high internal pressures upon quench. Alternatively, a cable in conduit (CICC) cooled by a flow of a coolant can be used for manufacturing the superconducting coils.

F) Structural Optimization

In the case of magnetic-field-shielding coils 31-36 and 41-46, the support between the magnets can be at the cryogenic temperature to avoid carrying large loads from the cryogenic environment to room temperature, which can be achieved by using low-thermal-conductivity straps 67. The magnetic loads are transferred through the cryogenic environment, but these loads are substantially smaller than the ones due to the magnetic loads between warm iron and cold superconducting coil, as in the case of the conventional K250 cyclotron. Additionally, the absence of the room-temperature iron removes the requirement that the elastic stiffness of the cold-to-warm supports offset magnetic instability due to the interaction between the coils and the iron. In the case of magnetic-field-shielding coils 31-36 and 41-46, the straps 67 can be made from metals (e.g., steel).

The cold mass includes the primary coils 12, 14, field-shaping coils 51-56, and magnetic-field-shielding coils 31-36 and 41-46 integrated in the coil structure and maintained at the cryogenic temperature required to keep a low-temperature superconductor (LTS) in the superconducting state. In synchrocyclotrons, these coils are all solenoids. In isochronous cyclotrons, some of the field-shaping coils 64 can have different shapes (e.g., spiral coils) for generating the flutter component of the magnetic field, or can be replaced by the cold iron tips 65 for generating flutter, or a combination of the above can be used, as shown in FIGS. 15 and 16.

Magnetic-field-shielding coils 31-36 can be part of the cold mass if made of LTS or can be combined with the radiation shield if high-temperature superconductor (HTS) is used for their design. In either case, the fact that the currents in the primary coils 12, 14 and in the magnetic-field-shielding coils 31-36 are opposite has an impact on the selection of the design of the mechanical coil supports.

Figure 17:
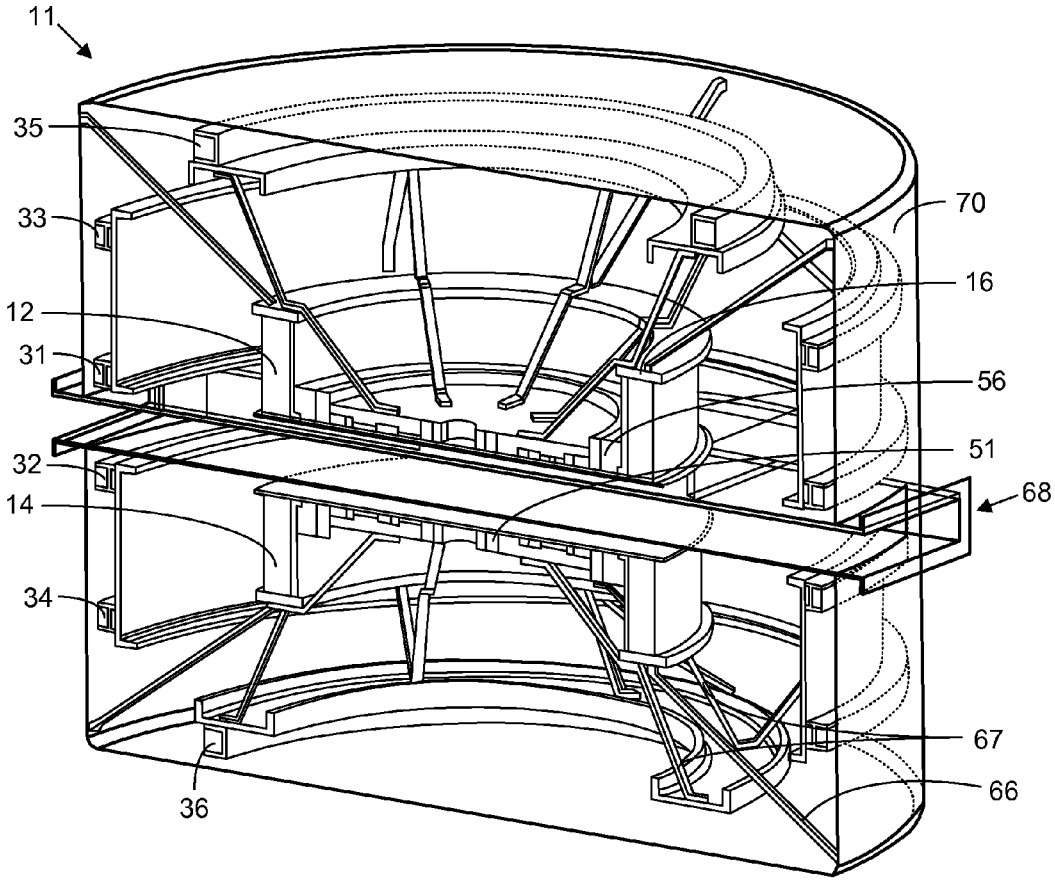
FIGS. 17 and 18 provide two perspective cross-sectional views of the primary coils, field-shaping coils and magnetic-field-shielding coils inside a cryostat and supported by a tension link and post structure.
Figure 18:
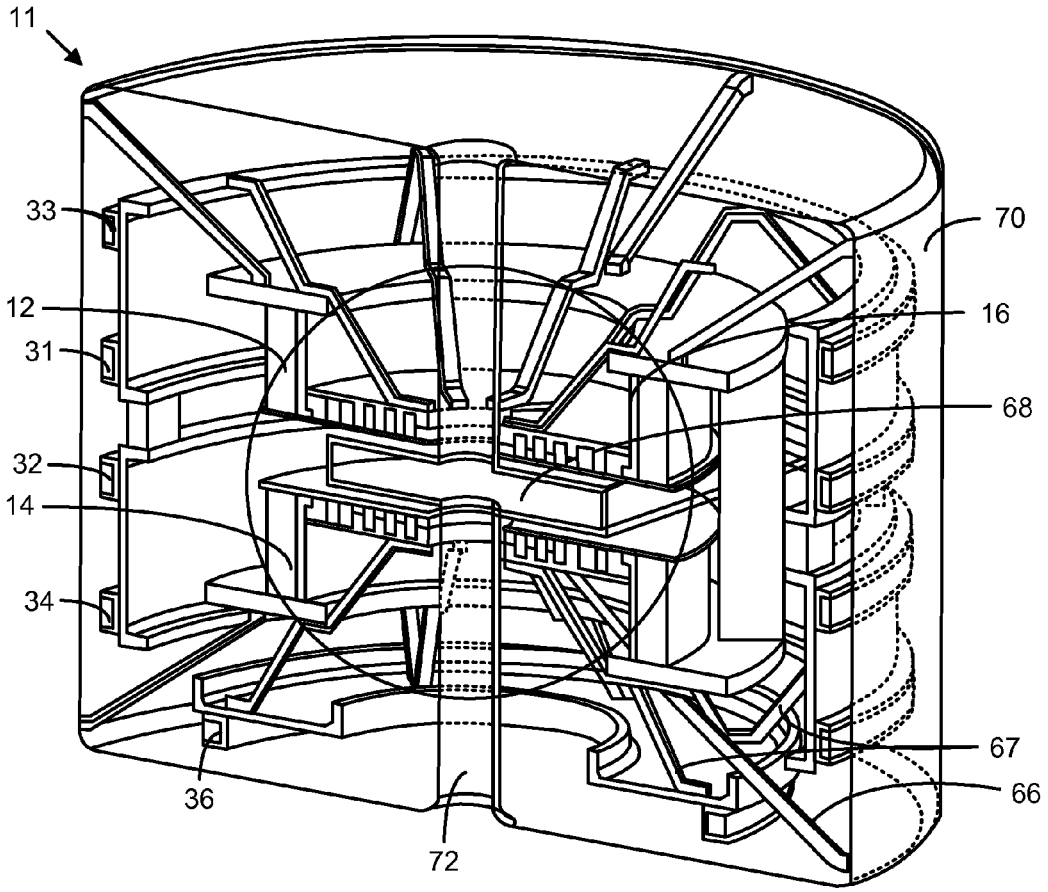

A design with the tension links 66 shown in FIGS. 17 and 18 (or tension links similar thereto) may be the most advantageous option. Tension links 66 made of high-strength and low-thermal-conductivity structural materials are used to support the cold mass off the outer walls of the cryostat 70. The upper and the lower halves of the cold mass are connected by rigid structural elements through the mid-plane. The cold-to-warm tension links 66 are pre-tensioned and positioned so that they are always in tension. Magnetic-field-shielding coils 31-36 and their bobbins are supported by the straps 67 off the integrated structure of the primary coils 12, 14 and field-shaping coils 51-56. The upper and the lower halves of the structure of the magnetic-field-shielding coils 31-36 are connected by rigid structural elements through the mid-plane. Due to the repulsion between the primary coils 12, 14 and the magnetic-field-shielding coils 31-36, these straps 67 provide both axial and lateral stability of the magnetic-field-shielding coils 31-36. Without the connecting straps 67, the assemblies of the primary coils 12, 14 and the magnetic-field-shielding coils 31-36 form two mechanical systems that are unstable in the tilting degree of freedom; and small lateral or angular offsets of their magnetic axes can result in the forces tending to overturn the magnetic-field-shielding coils 31-36. These forces are proportional to the offsets and are small if the offsets are limited by the tolerances permitted by the system requirements. Tensile forces in the straps 67 due to the repulsion between the primary coils 12, 14 and the magnetic-field-shielding coils 31-36 offset these small overturning forces by far.

In another embodiment of the proposed iron-free cyclotron 11, advantage can be taken from the use of high-temperature superconductors (HTS) by integrating the magnetic-field-shielding coils 31-36 with the intermediate thermal radiation shield or shields. For example, a coated HTS conductor made from YBCO or rare-earth barium-copper-oxide (REBCO) tapes can be wound and integrated directly onto a thermal shield at a temperature between, e.g., 20K to 50K. The thermal shield will act as both a support for the magnetic-field-shielding coils 31-36 and as a thermal mass heat sink to cool and maintain the magnetic-field-shielding coils 31-36 in the superconducting state. Typically, the thermal shield is made from copper or aluminum, both of which are excellent thermal conductors. This arrangement has the advantage of improving the cool-down time of the cyclotron 11 because the shield can be directly coupled to a cryocooler, thus cooling the magnetic-field-shielding coils 31-36 simultaneously with the thermal shield. The electromagnetic forces between the magnetic-field-shielding coils 31-36 and the field-shaping coils 51-56 still use an inter-coil structure.

In the iron-free design, all coils and electromagnetic (EM) forces are contained within the cryostat 70. The only external forces on the cold mass are due to gravity and possible magnetic interaction with magnetic fields from the equipment or magnetized iron in the vicinity of the magnet, all of which are usually much smaller than the internal electromagnetic forces between coils. The fields from the equipment are contained within allowable limits; or, if that is impossible, a cage is installed around the cyclotron 11. Magnetization of iron in the vicinity of and caused by the field of the cyclotron 11 magnet is mitigated by its magnetic shielding.

The containment of the EM forces within the magnet of the iron-free cyclotron 11 presents a significant advantage over the traditional design with the room-temperature yoke 23 and poles 21, in which the cold mass is attracted to the yoke 23 and is mechanically unstable with respect to practically all degrees of freedom. These forces result in additional requirements of the cold mass supports, which limit their heat-insulating efficiency.

G) Modular System Design

Figure 19:
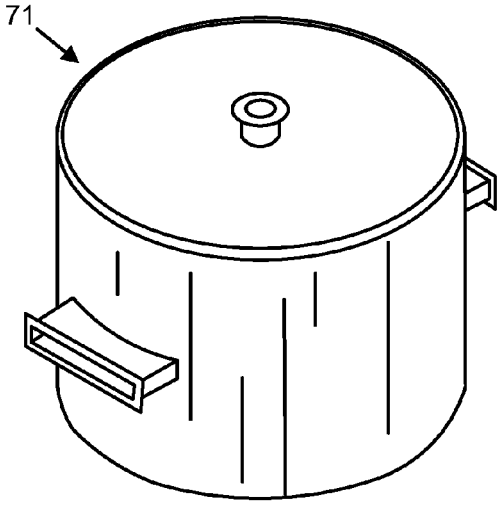
FIGS. 19 and 20 provide perspective views of the magnet cryostats with the cavities for the beam-acceleration subsystems or replaceable cassettes containing the beam-acceleration subsystems.
Figure 20:
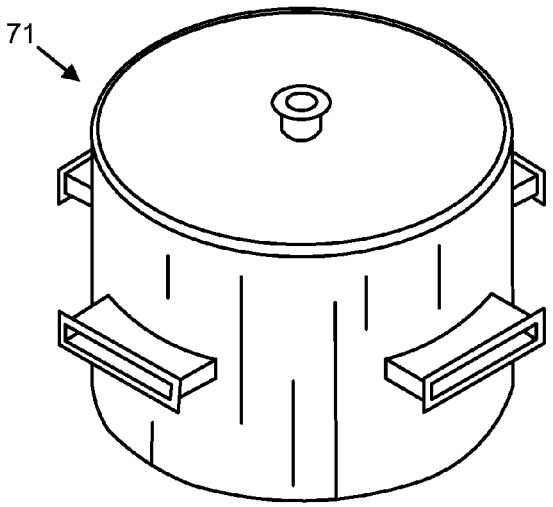

The proposed design of the iron-free and reduced-iron cyclotrons 11 can be modular, comprising a magnet in a cryostat 70 and beam-acceleration subsystems including, but not limited to, the beam chamber 68, RF cavities, an ion source 29 (see FIG. 4), and a beam-extraction system. The beam-acceleration sub-systems are incorporated into a single cassette module 71, as shown in FIGS. 19 and 20 that can be inserted into mid-plane tunnel 68 and referenced to an access port in the magnet-system cryostat 70.

Beam acceleration subsystems can be contained in the vacuum space formed by the walls of the cryostat 70 and vacuum-tight flanges closing the mid-plane tunnels 68 and at cylindrical axial bore 72 penetrations shown in FIG. 18. The cylindrical axial bore 72 penetrations can contain an external beam source or an additional pair of room-temperature solenoids for shaping the field required for weak focusing at low beam energies.

To facilitate switching between two types of accelerated particles, two external or internal ion sources can be installed from the opposite ends of the vertical bore 72 along the central axis 28 of the cyclotron 11. Switching between the ion sources will be done by shifting this ion-source assembly axially. The beam vacuum space will stay intact due to the bellows at both ends of the ion-source assembly. Switching between assemblies of magnetic bumps used for the beam extraction can be done similarly, only the magnetic-bump assemblies are moved in and out of the cyclotron 11 radially in the mid-plane tunnels 68.

Another option that is used in other cyclotrons but is especially attractive to embodiments discussed herein (because of the large gap about the midplane 18 in various embodiments of this design) is a modular, vacuum-tight cassette 71 (combining the beam chamber, RF cavities, ion source and beam extraction system) inserted into the mid-plane tunnel 68 of the cryostat 70. The axial extent of this open space tunnel can be more than 10 cm, which is much greater than in the traditional synchrocyclotrons with the iron yoke 23 and poles 21, in which open space is limited to small axial gaps defined by the iron fingers 24, 26, required for creating an adequate field profile. Some embodiments of this design can use room-temperature solenoids or iron inserts integrated with other subsystems in the mid-plane tunnel 68 and serving for shimming to achieve a better field quality. In the case of the iron shims, field scaling laws either do not apply or apply with some limitations.

The design with replaceable cassettes specially designed and tuned for a specific particle and/or beam energies can be used with predictable time of transitioning from one energy or ion species to another.

H) Relative Ease of Manufacture

Generally speaking, an iron-free cyclotron 11 is expected to be easier to manufacture and to operate than its conventional equivalent.

A major uncertainty in the manufacture of conventional cyclotrons is that although a fixed material is specified, the magnetization of the iron yoke 23 and pole 21 pieces can vary significantly between lots and even between locations within each component. This means that the field profile for a conventional cyclotron may need to be individually adjusted to achieve the profile needed for particle acceleration. This correction is in addition to any adjustment needed to account for the manufacturing tolerances for the primary coils 12, 14, yoke 23 and poles 21. Second, the primary coil pair 12, 14, within its cryostat 70, needs to be carefully aligned following cool-down to the iron yoke 23 and poles 21 that remain at room temperature. This alignment procedure is typically performed after the cyclotron has been installed in its final use location.

By comparison, because all of the coil sets in an iron-free cyclotron 11 are rigidly interconnected as part of a single cryostat cold mass, it is envisioned that the required acceleration-field profile can be mapped and adjusted in the factory before the cold mass is inserted into its cryostat 70 and that no in-field alignment procedures would be needed. The only field errors that may need correction during this procedure would be those associated with manufacturing tolerances for the coil sets.

I) Discussion

The use of a set of magnetic-field-shielding coils 31-36 is described, above. There are advantages and disadvantages, but the use of magnetic-field-shielding coils 31-36 dramatically decreases the weight of a cyclotron 11.

In the case of superconducting magnetic-field-shielding coils 31-36, although the overall weight of the system markedly decreases, the size of the cryostat 70 increases substantially compared to that for a conventional equivalent with iron yoke 23 and poles 21. In the case of the magnetic-field-shielding coils 31-36, the cryostat 70 surrounds both the primary coils 12, 14 and the magnetic-field-shielding coils 31-36. When superconducting field-shaping coils 51-56 are used, the cryostat 70 also encloses the magnetic-field-shaping coils 51-56. The cryostat 70 can be made from magnetic material (e.g., iron); but, for weight minimization, a preferred approach may be to use an aluminum cryostat. To circumvent the structural concerns regarding the use of aluminum cryostats, the structural requirements can be addressed by using an aluminum cryostat with a cladding. The cladding can be formed of iron or stainless steel. The impact of the iron on magnetic field-shielding is minimal.

The iron-free (or iron-reduced) designs are particularly attractive for high-field, compact cyclotrons, since the iron would otherwise be saturated in these devices. However, the concept can also be useful for low-field cyclotrons for decreasing the weight if not the size of the cyclotron.

Because of the improved mid-plane access and support due to the use of the iron-free or reduced-iron concepts, it is possible to easily change the internals of the cyclotron 11, including placing/modifying internal targets, modifying the beam-accelerating structure, changing the beam detectors, changing the beam-extraction radius and energy, etc.

The present application provides significant advantages compared with the present state of the art. In addition to the advantages mentioned above, the large gap around the mid-plane 18 that is facilitated by the use of magnetic-field-shielding coils 31-36 allows for easy access to this area through windows between posts connecting upper and lower halves of the cryostat 70, allowing for easy radial maintenance of the chamber, the ion source, and the accelerating structures. In particular, beam chambers can be made replaceable and modular (e.g., by incorporation into exchangeable cassettes 71, for different extraction radii and beam energies.

In describing embodiments of the invention, specific terminology is used for the sake of clarity. For the purpose of description, specific terms are intended to at least include technical and functional equivalents that operate in a similar manner to accomplish a similar result. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties or other values are specified herein for embodiments of the invention, those parameters or values can be adjusted up or down by $1/100^{th}$, $1/50^{th}$, $1/20^{th}$, $1/10^{th}$, $1/5^{th}$, $1/3^{rd}$, $1/2$, $2/3^{rd}$, $3/4^{th}$, $4/5^{th}$, $9/10^{th}$, $19/20^{th}$, $49/50^{th}$, $99/100^{th}$, etc. (or up by a factor of 1, 2, 3, 4, 5, 6, 8, 10, 20, 50, 100, etc.), or by rounded-off approximations thereof, unless otherwise specified. Moreover, while this invention has been shown and described with references to particular embodiments thereof, those skilled in the art will understand that various substitutions and alterations in form and details may be made therein without departing from the scope of the invention. Further still, other aspects, functions and advantages are also within the scope of the invention; and all embodiments of the invention need not necessarily achieve all of the advantages or possess all of the characteristics described above. Additionally, steps, elements and features discussed herein in connection with one embodiment can likewise be used in conjunction with other embodiments. The contents of references, including reference texts, journal articles, patents, patent applications, etc., cited throughout the text are hereby incorporated by reference in their entirety; and appropriate components, steps, and characterizations from these references may or may not be included in embodiments of this invention. Still further, the components and steps identified in the Background section are integral to this disclosure and can be used in conjunction with or substituted for components and steps described elsewhere in the disclosure within the scope of the invention. In method claims, where stages are recited in a particular order—with or without sequenced prefacing characters added for ease of reference—the stages are not to be interpreted as being temporally limited to the order in which they are recited unless otherwise specified or implied by the terms and phrasing.

What is claimed is:

1. A method for magnetically shielding a cyclotron during ion acceleration, comprising:

passing electrical current through first and second superconducting primary coils, wherein each superconducting primary coil is centered symmetrically about a central axis, one on each side of a midplane intersected perpendicularly by the central axis, wherein the electrical current is passed through the first superconducting primary coil in the same direction as the direction in which electrical current is passed through the second superconducting primary coil;

passing electrical current through at least a first and a second magnetic-field-shielding coil, wherein the first magnetic-field-shielding coil is on the same side of the mid plane as the first superconducting primary coil and beyond the outer radius of the first superconducting primary coil, wherein the second magnetic-field-shielding coil is on the same side of the midplane as the second superconducting primary coil and beyond the outer radius of the second superconducting primary coil, wherein electrical current is passed through the first and second magnetic-field-shielding coils in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils;

releasing an ion from an ion source into the midplane proximate the central axis and accelerating the ion in an orbiting trajectory expanding outward from the central axis via a magnetic field generated at least partially by the superconducting primary coils; and shaping the magnetic field in the midplane using at least a first and a second superconducting magnetic-field-shaping coil, wherein the first and second superconducting magnetic-field-shaping coils are positioned at shorter radii from the central axis than the superconducting primary coils.

2. The method of claim 1, wherein the cyclotron lacks a continuous yoke and pole structure around the superconducting primary coils.

3. The method of claim 2, wherein the magnetic field in the midplane is generated by a magnetic-field-generating structure consisting essentially of the superconducting primary coils, the superconducting magnetic-field-shaping coils, and the magnetic-field-shielding coils.

4. The method of claim 2, further comprising changing the magnetic field generated in the midplane while maintaining magnetic shielding by changing the amount of current passed through the superconducting primary coils and through the magnetic-field-shielding coils and maintaining the magnetic field profile in the midplane by proportionally changing the electrical currents in the superconducting primary coils, in the superconducting field-shaping coils, and in the magnetic-field-shielding coils so that the amplitude of the magnetic field changes but the normalized gradient of the magnetic field remains constant.

5. The method of claim 4, further comprising extracting the ion from the cyclotron with a final energy, wherein the final energy of the extracted ion changes as the magnetic field is changed.

6. The method of claim 5, wherein a plurality of ions are accelerated by the cyclotron to produce an ion beam, the method further comprising scanning the ion beam through living tissue while varying the energy of the ion beam over time.

7. The cyclotron of claim 1, wherein the cyclotron has a mass less than 5,000 kg.

8. A method for magnetically shielding a cyclotron during ion acceleration, comprising:

passing electrical current through first and second superconducting primary coils, wherein each superconducting primary coil is centered symmetrically about a central axis, one on each side of a midplane intersected perpendicularly by the central axis, wherein the electrical current is passed through the first superconducting primary coil in the same direction as the direction in which electrical current is passed through the second superconducting primary coil;

passing electrical current through at least a first and a second magnetic-field-shielding coil, wherein the first magnetic-field-shielding coil is on the same side of the mid plane as the first superconducting primary coil and beyond the outer radius of the first superconducting primary coil, wherein the second magnetic-field-shielding coil is on the same side of the midplane as the second superconducting primary coil and beyond the outer radius of the second superconducting primary coil, wherein electrical current is passed through the first and second magnetic-field-shielding coils in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils; and releasing an ion from an ion source into the midplane proximate the central axis and accelerating the ion in an orbiting trajectory expanding outward from the central axis via a magnetic field generated at least partially by the superconducting primary coils, wherein the magnetic field generated in the midplane at radii less than the inner radius of the superconducting primary coils is greater than 5 Tesla.

9. A method for magnetically shielding a cyclotron during ion acceleration, comprising:

passing electrical current through first and second superconducting primary coils, wherein each superconducting primary coil is centered symmetrically about a central axis, one on each side of a midplane intersected perpendicularly by the central axis, wherein the electrical current is passed through the first superconducting primary coil in the same direction as the direction in which electrical current is passed through the second superconducting primary coil;

passing electrical current through at least a first and a second magnetic-field-shielding coil, wherein the first magnetic-field-shielding coil is on the same side of the mid plane as the first superconducting primary coil and beyond the outer radius of the first superconducting primary coil, wherein the second magnetic-field-shielding coil is on the same side of the midplane as the second superconducting primary coil and beyond the outer radius of the second superconducting primary coil, wherein electrical current is passed through the first and second magnetic-field-shielding coils in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils; and releasing an ion from an ion source into the midplane proximate the central axis and accelerating the ion in an orbiting trajectory expanding outward from the central axis via a magnetic field generated at least partially by the superconducting primary coils, wherein the magnetic field generated at radii greater than 1 meter beyond the outer radius of the superconducting primary coils is reduced to less than 0.001 Tesla by the magnetic-field-shielding coils.

10. A method for magnetically shielding a cyclotron during ion acceleration, comprising:

passing electrical current through first and second superconducting primary coils, wherein each superconducting primary coil is centered symmetrically about a central axis, one on each side of a midplane intersected perpendicularly by the central axis, wherein the electrical current is passed through the first superconducting primary coil in the same direction as the direction in which electrical current is passed through the second superconducting primary coil;

passing electrical current through at least a first and a second magnetic-field-shielding coil, wherein the first magnetic-field-shielding coil is on the same side of the mid plane as the first superconducting primary coil and beyond the outer radius of the first superconducting primary coil, wherein the second magnetic-field-shielding coil is on the same side of the midplane as the second superconducting primary coil and beyond the outer radius of the second superconducting primary coil, wherein electrical current is passed through the first and second magnetic-field-shielding coils in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils;

releasing ions from an ion source into the midplane proximate the central axis and accelerating the ions in an orbiting trajectory expanding outward from the central axis via magnetic fields generated at least partially by the superconducting primary coils, wherein different ions having different masses are accelerated in the cyclotron, and magnetic fields of different magnitudes are generated for the different ions.

11. The method of claim 10, further comprising replacing a beam-acceleration module including the ion source, radiofrequency electrodes, a beam chamber and a beam-extraction system between accelerations of the different ions.

12. A method for magnetically shielding a cyclotron during ion acceleration, comprising:

passing electrical current through first and second superconducting primary coils, wherein each superconducting primary coil is centered symmetrically about a central axis, one on each side of a midplane intersected perpendicularly by the central axis, wherein the electrical current is passed through the first superconducting primary coil in the same direction as the direction in which electrical current is passed through the second superconducting primary coil;

passing electrical current through at least a first and a second magnetic-field-shielding coil, wherein the first magnetic-field-shielding coil is on the same side of the mid plane as the first superconducting primary coil and beyond the outer radius of the first superconducting primary coil, wherein the second magnetic-field-shielding coil is on the same side of the midplane as the second superconducting primary coil and beyond the outer radius of the second superconducting primary coil, wherein electrical current is passed through the first and second magnetic-field-shielding coils in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils; and releasing an ion from an ion source into the midplane proximate the central axis and accelerating the ion in an orbiting trajectory expanding outward from the central axis via a magnetic field generated at least partially by the superconducting primary coils, wherein at least some of the superconducting magnetic-field-shielding coils are positioned at a radius from the central axis more than 1.5 times the radius of the superconducting primary coils.

13. A method for magnetically shielding a cyclotron during ion acceleration, comprising:

passing electrical current through first and second superconducting primary coils, wherein each superconducting primary coil is centered symmetrically about a central axis, one on each side of a midplane intersected perpendicularly by the central axis, wherein the electrical current is passed through the first superconducting primary coil in the same direction as the direction in which electrical current is passed through the second superconducting primary coil;

passing electrical current through at least a first and a second magnetic-field-shielding coil, wherein the first magnetic-field-shielding coil is on the same side of the mid plane as the first superconducting primary coil and beyond the outer radius of the first superconducting primary coil, wherein the second magnetic-field-shielding coil is on the same side of the midplane as the second superconducting primary coil and beyond the outer radius of the second superconducting primary coil, wherein electrical current is passed through the first and second magnetic-field-shielding coils in a direction opposite to the direction in which electrical current is passed through the superconducting primary coils, and wherein passing electrical current through the magnetic-field-shielding coils generates a canceling magnetic field that reduces the magnetic field generated at radii from the central axis beyond the magnetic-field-shielding coils; and releasing an ion from an ion source into the midplane proximate the central axis and accelerating the ion in an orbiting trajectory expanding outward from the central axis via a magnetic field generated at least partially by the superconducting primary coils, wherein shielding of magnetic fields generated by the primary coils at radii from the central axis beyond the superconducting primary coils is provided by a magnetic-field-shielding structure consisting essentially of the magnetic-field-shielding coils.

14. The method of claim 13, wherein the magnetic-field-shielding coils are superconducting.

15. The method of claim 13, further comprising shaping the magnetic field in the midplane using at least a first and a second superconducting magnetic-field-shaping coil, wherein the first and second superconducting magnetic-field-shaping coils are positioned at shorter radii from the central axis than the superconducting primary coils.

16. A magnetically shielded, compact cyclotron, comprising:

first and second superconducting primary coils, wherein each superconducting primary coil is centered about a central axis, one on each side of a midplane intersected perpendicularly by the central axis;

a current source electrically coupled with the first and second superconducting primary coils and configured to direct electrical current through the first and second superconducting primary coils in the same direction;

at least a first and a second magnetic-field-shielding coil centered about the central axis and at radii from the central axis beyond the superconducting primary coils, wherein the first magnetic-field-shielding coil is positioned on the same side of the midplane as the first superconducting primary coil, wherein the second magnetic-field-shielding coil is positioned on the same side of the midplane as the second superconducting primary coil, wherein the current source is electrically coupled with the first and second magnetic-field-shielding coils and configured to direct electrical current through the first and second magnetic-field-shielding coils in a direction that is opposite to the direction in which the electrical current is passing through the superconducting primary coils;

an ion source positioned to release an ion in the midplane for an outwardly orbiting acceleration; and at least a first and a second superconducting magnetic-field-shaping coil, wherein the first and second superconducting magnetic-field-shaping coils are positioned at shorter radii from the central axis than the superconducting primary coils.

17. The cyclotron of claim 16, wherein the cyclotron is a synchrocyclotron.

18. The cyclotron of claim 17, wherein the synchrocyclotron includes a magnetic-field-generating structure consisting essentially of the superconducting primary coils, the superconducting magnetic-field-shaping coils and the magnetic-field-shielding coils.

19. The cyclotron of claim 16, wherein the cyclotron is an isochronous cyclotron that generates an azimuthally fixed magnetic field and an azimuthally varying magnetic field.

20. The cyclotron of claim 19, wherein the isochronous cyclotron includes a magnetic-field-generating structure for generating the azimuthally fixed magnetic field that consists essentially of the superconducting primary coils, the superconducting magnetic-field-shaping coils and the superconducting magnetic-field-shielding coils.

21. The cyclotron of claim 20, wherein the isochronous cyclotron includes a magnetic-field-generating structure for generating the azimuthally variable magnetic field that consists essentially of sectors of spiral conductive coil windings.

22. The cyclotron of claim 20, wherein the isochronous cyclotron includes a magnetic-field-generating structure comprising iron for generating the azimuthally variable magnetic field.

23. The cyclotron of claim 16, wherein the magnetic-field-shielding coils are superconducting.

24. The cyclotron of claim 16, further comprising:

a radiofrequency accelerator system positioned and configured to generate a radiofrequency alternating electromagnetic field in the midplane for accelerating an orbiting ion in the cyclotron; and an extraction system positioned and configured to extract the orbiting ion from the cyclotron.

* * * * *